US008056145B2

(12) United States Patent
Shamsnobari et al.

(10) Patent No.: US 8,056,145 B2
(45) Date of Patent: Nov. 15, 2011

(54) FOOD HOLDER

(76) Inventors: Shahriar K. Shamsnobari, Sherman Oaks, CA (US); Behzad Bahadori, Manhattan Beach, CA (US)

( * ) Notice: Subject to any disclaimer, the term of this patent is extended or adjusted under 35 U.S.C. 154(b) by 167 days.

(21) Appl. No.: 12/590,595

(22) Filed: Nov. 10, 2009

(65) Prior Publication Data

US 2010/0163610 A1 Jul. 1, 2010

Related U.S. Application Data

(63) Continuation-in-part of application No. 12/381,593, filed on Mar. 13, 2009.

(60) Provisional application No. 61/069,226, filed on Mar. 13, 2008.

(51) Int. Cl.
*A41D 27/12* (2006.01)

(52) U.S. Cl. ..... 2/46; 2/49.2

(58) Field of Classification Search ..... 2/48, 49.1–49.5, 2/51, 52, 46, 50, 92; 229/165, 164, 164.1, 229/800, 904, 172; 206/541, 542, 546, 548, 206/549; 383/105, 111, 114, 4, 104, 902; 224/148.1, 148.5, 148.4, 575, 576, 906, 600, 224/607, 270

See application file for complete search history.

(56) References Cited

U.S. PATENT DOCUMENTS

| | | | | | |
|---|---|---|---|---|---|
| 2,265,690 | A * | 12/1941 | Fiedler | 2/48 |
| 2,367,383 | A * | 1/1945 | Tiscornia | 2/49.3 |
| 2,704,625 | A * | 3/1955 | Huse | 224/576 |
| 3,773,244 | A * | 11/1973 | Dunlap et al. | 206/590 |
| 4,114,199 | A * | 9/1978 | Malan | 2/49.3 |
| 4,391,405 | A * | 7/1983 | Drinon | 229/145 |
| 4,649,572 | A * | 3/1987 | Roessler | 2/49.2 |
| 4,821,881 | A * | 4/1989 | Yabe | 229/165 |
| 4,887,315 | A * | 12/1989 | Bezdek | 2/46 |
| 4,946,094 | A * | 8/1990 | Stang | 224/270 |
| 5,056,159 | A * | 10/1991 | Zemke, Jr. | 2/46 |
| 5,062,558 | A * | 11/1991 | Stang | 224/270 |
| 5,107,545 | A * | 4/1992 | Potter | 2/46 |
| 5,507,579 | A * | 4/1996 | Sorenson | 383/207 |
| 5,522,538 | A * | 6/1996 | Gray | 229/112 |
| 5,964,534 | A * | 10/1999 | Welles | 383/66 |
| 6,102,208 | A * | 8/2000 | Huang | 206/541 |
| 6,349,874 | B1 * | 2/2002 | Hill | 229/120.18 |
| 6,826,780 | B1 * | 12/2004 | Romesburg | 2/49.2 |
| 7,140,532 | B2 * | 11/2006 | Holt et al. | 229/120.13 |
| 7,273,162 | B2 * | 9/2007 | Baker | 229/120.13 |
| 7,360,256 | B1 * | 4/2008 | Jiles et al. | 2/49.1 |
| 2001/0054191 | A1 * | 12/2001 | Frye | 2/49.2 |
| 2002/0066133 | A1 * | 6/2002 | Frye | 2/49.1 |
| 2006/0174390 | A1 * | 8/2006 | Wakhloo et al. | 2/48 |
| 2008/0060108 | A1 * | 3/2008 | Gors | 2/48 |

* cited by examiner

*Primary Examiner* — Amy Vanatta

(57) ABSTRACT

A food tray is disclosed that prevents direct contact of the food items with the hands of a consumer and prevents the food to spill on the consumer clothes. In some embodiments, the food tray includes a back panel, two side panels, four flaps, and a midsection. During the consumption of the food item, the two side panels and the midsection form an apron which is placed under the chin of the consumer to prevent the food from spilling on the consumer cloths. In some embodiments, the midsection includes a chin curve that facilitates placing the apron under the chin of the consumer.

16 Claims, 21 Drawing Sheets

FOOD HOLDER

CLAIM OF BENEFIT TO PRIOR APPLICATIONS

This application is a continuation in part of U.S. patent application Ser. No. 12/381,593, entitled, "Food Holder," filed on Mar. 13, 2009. U.S. patent application Ser. No. 12/381,593 claims the benefit of U.S. Provisional Application 61/069,226, entitled "Food Holder," filed Mar. 13, 2008. The contents of U.S. patent application Ser. No. 12/381,593 and U.S. Provisional Patent Application 61/069,226 are incorporated herein by reference.

FIELD OF THE INVENTION

The present invention is directed towards packaging of food products and more particularly to food holders for sandwiches, hamburgers, hotdogs, and the like.

BACKGROUND OF THE INVENTION

Disposable packages such as Styrofoam containers, paper bags, cardboard boxes, carton, and sandwich wraps are widely used in restaurants, particularly those known as fast food restaurants for dispensing sandwiches, hamburgers, hotdogs, burritos, and the like. Many consumers, who purchase fast food items, consume it while standing, walking, or sitting in a car. Often, eating the food item would cause spillage of food items and garnishing on the consumer clothing. Also, the food item or garnishing may touch the consumer hand. Therefore, there is a need in the art for a food holder that is easy to hold, makes easy access to the food, and prevents spill.

SUMMARY OF THE INVENTION

A food tray is disclosed that prevents direct contact of the food items with the hands of a consumer and prevents the food to spill on the consumer clothes. In some embodiments, the food tray includes a back panel, three side panels, four flaps, and an apron. During the consumption of the food item, the apron is placed under the chin of the consumer to prevent the food from spilling on the consumer cloths. In some embodiments, the food tray is stackable for the ease of storage and transportation. In some embodiments, a notch on a side panel provides easy grip for the food tray.

Some embodiments provide a food container that includes a back panel. The food container also includes a first and second side panels that are hingedly connected to the back panel. The food container also includes third and fourth side panels that are hingedly connected to the second side panel. The first, second, third, and fourth side panels are at an upright position in relationship with the back panel forming a cavity for receiving a food item. The food container also includes a first flap that is hingedly connected to the third side panel. The first flap is connected to the outside of the first side panel. The food container also includes a second flap that is hingedly connected to the fourth side panel. The second flap is also connected to the outside of the first side panel. The food container also includes a mid panel that is hingedly connected to the second side panel. The food container also includes an apron that is hingedly connected to the mid panel. The apron can extend to under the chin of a consumer of the food item.

In some embodiments, the back panel includes an arcuate cut for pushing the food item outside the cavity during consumption of the food item. In some embodiments, the first and second flaps are glued to the first panel. In some embodiments, the food container further includes third and fourth flaps that are hingedly connected to the third and fourth side panels, respectively. In some embodiments, the third and fourth flaps are glued to the back panel. In some embodiments, the back panel, the first, second, third, and fourth side panels, the midsection, the first, second, third, and fourth flaps, and the apron are formed from a one piece blank. In some embodiments, the back panel, the first, second, third, and fourth side panels, the midsection, the first and second flaps, and the apron are formed from a one piece blank. In some embodiments, the cavity can further be used for stacking up the food container against similar food containers by placing the cavity of one food container inside the cavity of the next food container prior to placing a food item in the food container.

Some embodiments provide a food container that can prevent spillage during consumption of a food item. The food container includes a receptacle formed by a back panel and a first, second, third, and fourth side panels. The first side panel is connected to the back panel along a first fold line. The second side panel is connected to the back panel along a second fold line. The third and fourth side panels are connected to the second side panel along third and fourth fold lines, respectively. The cavity can hold a food item for human consumption. The food container also includes a first flap that is connected the third side panel along a fifth fold line. The first flap is adhered to the first side panel. The food container also includes a second flap that is connected to the fourth side panel along a sixth fold line. The second flap is adhered to the first side panel. The food container also includes a midsection that is hingedly connected to the second side panel along a seventh fold line. The midsection can move relative to the cavity along the seventh fold line. The food container also includes an apron that is hingedly connected to the mid panel along an eight fold line. The apron can move relative to the mid panel and the receptacle along the eight fold line. The apron can extend under the chin of a human during consumption of the food item.

In some embodiments, the back panel includes an arcuate cut for pushing the food item outside the receptacle during consumption of the food item. In some embodiments, the first and second flaps are glued to the first panel. In some embodiments, the food container further includes a third flap that is connected to the third side panel along a ninth fold line. The food container further includes a fourth flap that is connected to the fourth side panel along a tenth fold line. In some embodiments, the third and fourth flaps are glued to the back panel. In some embodiments, the back panel, the first, second, third, and fourth side panels, the midsection, the first, second, third, and fourth flaps, and the apron are formed from a one piece blank. In some embodiments, the back panel, the first, second, third, and fourth side panels, the midsection, the first and second flaps, and the apron are formed from a one piece blank. In some embodiments, the receptacle is further be used for stacking up the food container against similar food containers by placing the receptacle of one food container inside the receptacle of a next food container prior to placing a food item in the food container.

Some embodiments provide a food container that includes a back panel, a midsection that is hingedly connected to the back panel, and a first side panel and a second side panel. Each side panel is hingedly connected to the midsection. The food container also includes a first flap that is hingedly connected to the first side panel and a second flap that is hingedly connected to the second side panel. The food container also includes a third flap that is hingedly connected to the first flap and is hingedly connected to the back panel. The food container also includes a fourth flap that is hingedly connected to the second flap and is hingedly connected to the back panel. The back panel, the first and second side panels, the midsection, and the first, second, third, and fourth flaps form a cavity to receive a food item. The midsection, the first side panel, and the second side panel form an apron to place under the chin of a consumer of the food item during consumption of the food item.

Some embodiments provide a food container for preventing spillage during consumption of a food item. The food container includes a receptacle that is formed by a back panel, a midsection, and first and second side panels. The first and second side panels are connected to the midsection along first and second fold lines respectively. The midsection is connected to the back panel along a third fold line. The cavity is for holding a food item for human consumption. The food container also includes a first flap that is connected the first side panel along a fourth fold line. The food container also includes a second flap that is connected to the second side panel along a fifth fold line. The food container also includes a third flap that is connected to the first flap along a sixth fold line and is connected to the back panel along a seventh fold line. The food container also includes a fourth flap that is connected to the second flap along an eight fold line and is connected to the back panel along a ninth fold line. The midsection, the first side panel and the second side panel form an apron during consumption of the food item. The apron is placed under the chin of a human during consumption of the food item.

In some embodiments the food container includes a wrapping paper that is glued to the back panel. In some embodiments, the back panel, the first and second side panels, the midsection, and the first, second, third, and fourth flaps are formed from a one piece blank. In some embodiments, the midsection includes an arcuate cut for placing under the chin of the consumer during consumption of the food item.

In some embodiments, the food container includes a tape for connecting the first and second side panels together when the side panels are folded towards each other to form said cavity. In some embodiments, the food container includes a paper lock for connecting the first and second side panels together when said side panels are folded towards each other to form said cavity. In some embodiments, the paper lock includes a latch on the first side panel and a fissure on the second side panel. When the side panels are folded towards each other, the latch passes through the fissure. The fissure is narrower than the high width of the latch. In some embodiments, the paper lock includes a first fissure on the first side panel and a second fissure and a third fissure on the second side panel. The first fissure goes inside the second fissure and slides into the third fissure in order to lock the first and second side panels together when the side panels are folded towards each other.

BRIEF DESCRIPTION OF THE DRAWINGS

The novel features of the invention are set forth in the appended claims. However, for purpose of explanation, several embodiments of the invention are set forth in the following figures.

FIG. 16 illustrates the two-dimension shape of food holder of some embodiments for use with hotdogs, burritos or like.

DETAILED DESCRIPTION OF THE INVENTION

Figure 1:
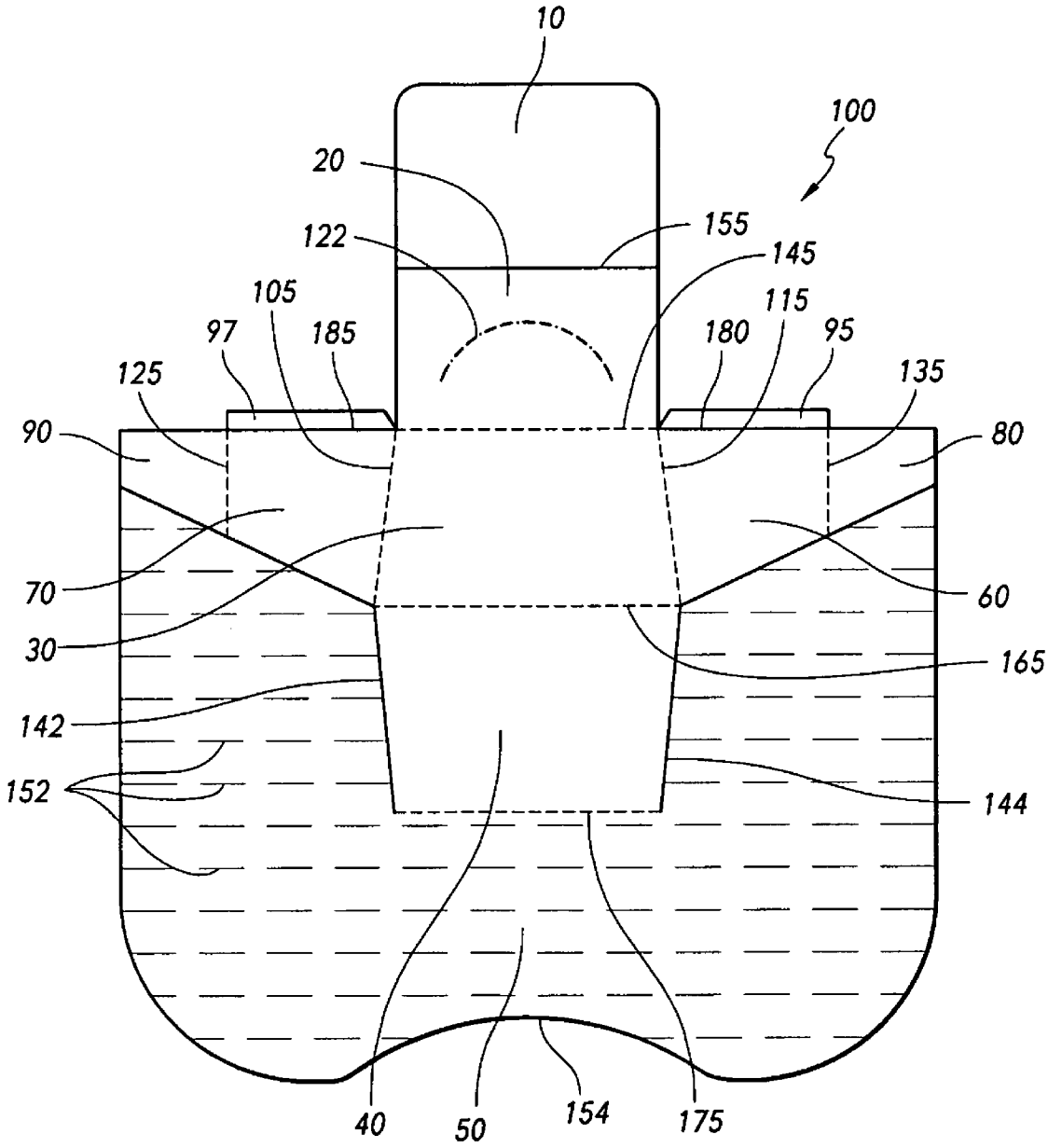
FIG. 1 illustrates a two dimensional view of the food holder according to some embodiments of the invention.

It will be apparent to those skilled in the art that various modifications or variations may be made in the present invention without departing from the scope or spirit of the invention. Other embodiments of the invention will apparent to those skilled in the art from consideration of the specification and practice of the invention disclosed herein.

A food tray is disclosed that prevents direct contact of the food items with the hands of a consumer and prevents the food to spill on the consumer clothes. In some embodiments, the food tray includes a back panel, three side panels, four flaps, and an apron. During the consumption of the food item, the apron is placed under the chin of the consumer to prevent the food from spilling on the consumer cloths. In some embodiments, the food tray is stackable for the ease of storage and transportation. In some embodiments, a notch on a side panel provides easy grip for the food tray.

Some embodiments provide a food container that includes a back panel. The food container also includes a first and second side panels that are hingedly connected to the back panel. The food container also includes third and fourth side panels that are hingedly connected to the second side panel. The first, second, third, and fourth side panels are at an upright position in relationship with the back panel forming a cavity for receiving a food item. The food container also includes a first flap that is hingedly connected to the third side panel. The first flap is connected to the outside of the first side panel. The food container also includes a second flap that is hingedly connected to the fourth side panel. The second flap is also connected to the outside of the first side panel. The food container also includes a mid panel that is hingedly connected to the second side panel. The food container also includes an apron that is hingedly connected to the mid panel. The apron can extend to under the chin of a consumer of the food item.

In some embodiments, the back panel includes an arcuate cut for pushing the food item outside the cavity during consumption of the food item. In some embodiments, the first and second flaps are glued to the first panel. In some embodiments, the food container further includes third and fourth flaps that are hingedly connected to the third and fourth side panels, respectively. In some embodiments, the third and fourth flaps are glued to the back panel. In some embodiments, the back panel, the first, second, third, and fourth side panels, the midsection, the first, second, third, and fourth flaps, and the apron are formed from a one piece blank. In some embodiments, the back panel, the first, second, third, and fourth side panels, the midsection, the first and second flaps, and the apron are formed from a one piece blank. In some embodiments, the cavity can further be used for stacking up the food container against similar food containers by placing the cavity of one food container inside the cavity of the next food container prior to placing a food item in the food container.

Some embodiments provide a food container that can prevent spillage during consumption of a food item. The food container includes a receptacle formed by a back panel and a first, second, third, and fourth side panels. The first side panel is connected to the back panel along a first fold line. The second side panel is connected to the back panel along a second fold line. The third and fourth side panels are connected to the second side panel along third and fourth fold lines, respectively. The cavity can hold a food item for human consumption. The food container also includes a first flap that is connected the third side panel along a fifth fold line. The first flap is adhered to the first side panel. The food container also includes a second flap that is connected to the fourth side panel along a sixth fold line. The second flap is adhered to the first side panel. The food container also includes a midsection that is hingedly connected to the second side panel along a seventh fold line. The midsection can move relative to the cavity along the seventh fold line. The food container also includes an apron that is hingedly connected to the mid panel along an eight fold line. The apron can move relative to the mid panel and the receptacle along the eight fold line. The apron can extend under the chin of a human during consumption of the food item.

In some embodiments, the back panel includes an arcuate cut for pushing the food item outside the receptacle during consumption of the food item. In some embodiments, the first and second flaps are glued to the first panel. In some embodiments, the food container further includes a third flap that is connected to the third side panel along a ninth fold line. The food container further includes a fourth flap that is connected to the fourth side panel along a tenth fold line. In some embodiments, the third and fourth flaps are glued to the back panel. In some embodiments, the back panel, the first, second, third, and fourth side panels, the midsection, the first, second, third, and fourth flaps, and the apron are formed from a one piece blank. In some embodiments, the back panel, the first, second, third, and fourth side panels, the midsection, the first and second flaps, and the apron are formed from a one piece blank. In some embodiments, the receptacle is further be used for stacking up the food container against similar food containers by placing the receptacle of one food container inside the receptacle of a next food container prior to placing a food item in the food container.

Some embodiments provide a food container that includes a back panel, a midsection that is hingedly connected to the back panel, and a first side panel and a second side panel. Each side panel is hingedly connected to the midsection. The food container also includes a first flap that is hingedly connected to the first side panel and a second flap that is hingedly connected to the second side panel. The food container also includes a third flap that is hingedly connected to the first flap and is hingedly connected to the back panel. The food container also includes a fourth flap that is hingedly connected to the second flap and is hingedly connected to the back panel. The back panel, the first and second side panels, the midsection, and the first, second, third, and fourth flaps form a cavity to receive a food item. The midsection, the first side panel, and the second side panel form an apron to place under the chin of a consumer of the food item during consumption of the food item.

Some embodiments provide a food container for preventing spillage during consumption of a food item. The food container includes a receptacle that is formed by a back panel, a midsection, and first and second side panels. The first and second side panels are connected to the midsection along first and second fold lines respectively. The midsection is connected to the back panel along a third fold line. The cavity is for holding a food item for human consumption. The food container also includes a first flap that is connected the first side panel along a fourth fold line. The food container also includes a second flap that is connected to the second side panel along a fifth fold line. The food container also includes a third flap that is connected to the first flap along a sixth fold line and is connected to the back panel along a seventh fold line. The food container also includes a fourth flap that is connected to the second flap along an eight fold line and is connected to the back panel along a ninth fold line. The midsection, the first side panel and the second side panel form an apron during consumption of the food item. The apron is placed under the chin of a human during consumption of the food item.

In some embodiments the food container includes a wrapping paper that is glued to the back panel. In some embodiments, the back panel, the first and second side panels, the midsection, and the first, second, third, and fourth flaps are formed from a one piece blank. In some embodiments, the midsection includes an arcuate cut for placing under the chin of the consumer during consumption of the food item.

In some embodiments, the food container includes a tape for connecting the first and second side panels together when the side panels are folded towards each other to form said cavity. In some embodiments, the food container includes a paper lock for connecting the first and second side panels together when said side panels are folded towards each other to form said cavity. In some embodiments, the paper lock includes a latch on the first side panel and a fissure on the second side panel. When the side panels are folded towards each other, the latch passes through the fissure. The fissure is narrower than the high width of the latch. In some embodiments, the paper lock includes a first fissure on the first side panel and a second fissure and a third fissure on the second side panel. The first fissure goes inside the second fissure and slides into the third fissure in order to lock the first and second side panels together when the side panels are folded towards each other. Several more embodiments are described in the following sections.

FIG. 1 illustrates a two dimensional view of a food holder (also referred to as food tray or food container) 100 according to some embodiments of the invention. As shown, the food holder 100 includes back panel 20; side panels 10, 30, 60, and 70; flaps 80, 90, 95, and 97; midsection 40; and apron 50. In some embodiments, back panel 20 has an arc shape cut 122 to facilitate consumption of a food item as described further below.

Edges 105, 115, 125, 135, 145, 155, 165, 175, 180, and 185 are foldable. As shown, apron 50 is connected to midsection 40 through the foldable edge 175. Apron 50 is not connected to any other parts of the food holder 100. Specifically, edges 142 and 144 between apron 50 and midsection 40 are cut to facilitate separation of the apron and the midsection during assembly. Similarly, the edges between apron 50 and flaps 90 and 80 as well the edges between apron 50 and side panels 70 and 60 are cut to facilitate assembly of the food tray 100.

In some embodiments, the apron has several folds (or crease lines) 152 to make the apron more flexible and to facilitate the use of the food holder as described below. Also, in some embodiments, apron 50 has a notch 154 to facilitate positioning the apron under the chin of a consumer as described below. Furthermore, flaps 95 and 97 are optional in some embodiments.

Figure 2:
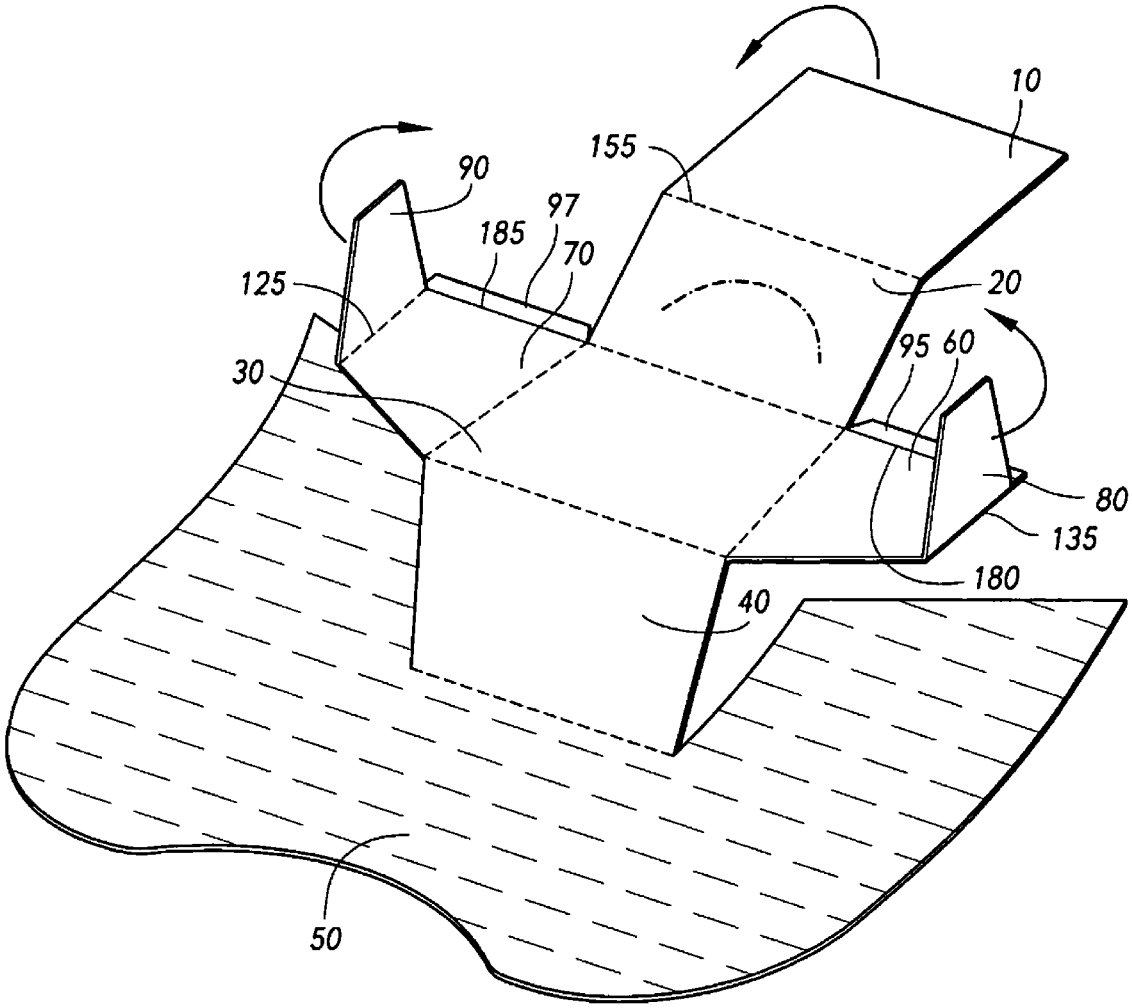
FIG. 2 illustrates a perspective view of the food holder according to some embodiments.

FIG. 2 illustrates a perspective view of the food holder of some embodiments. In order to assemble the smart tray, side panel 10 and flaps 90 and 80 are folded (as shown by arrows A, B, and C) over edges 155, 125, and 135 respectively. Side panel 10 and flaps 90 and 80 are folded at an approximate angle of 90 degrees with panels 20, 70, and 60 respectively.

Next, back panel 20 is folded over edge 145 at an approximate angle of 90 degrees with the side panel 30. This fold brings side panel 10 in a plane that is approximately parallel to the back panel 30. Next, side panels 70 and 60 are folded over edges 105 and 115 respectively. Side panels 70 and 60 are folded to an approximate angle of 90 degrees with the side panel 30. Next, flaps 95 and 97 are folded over edges 180 and 185 respectively. These folds bring flaps 95 and 97 in touch with the back panel 20.

Figure 3:
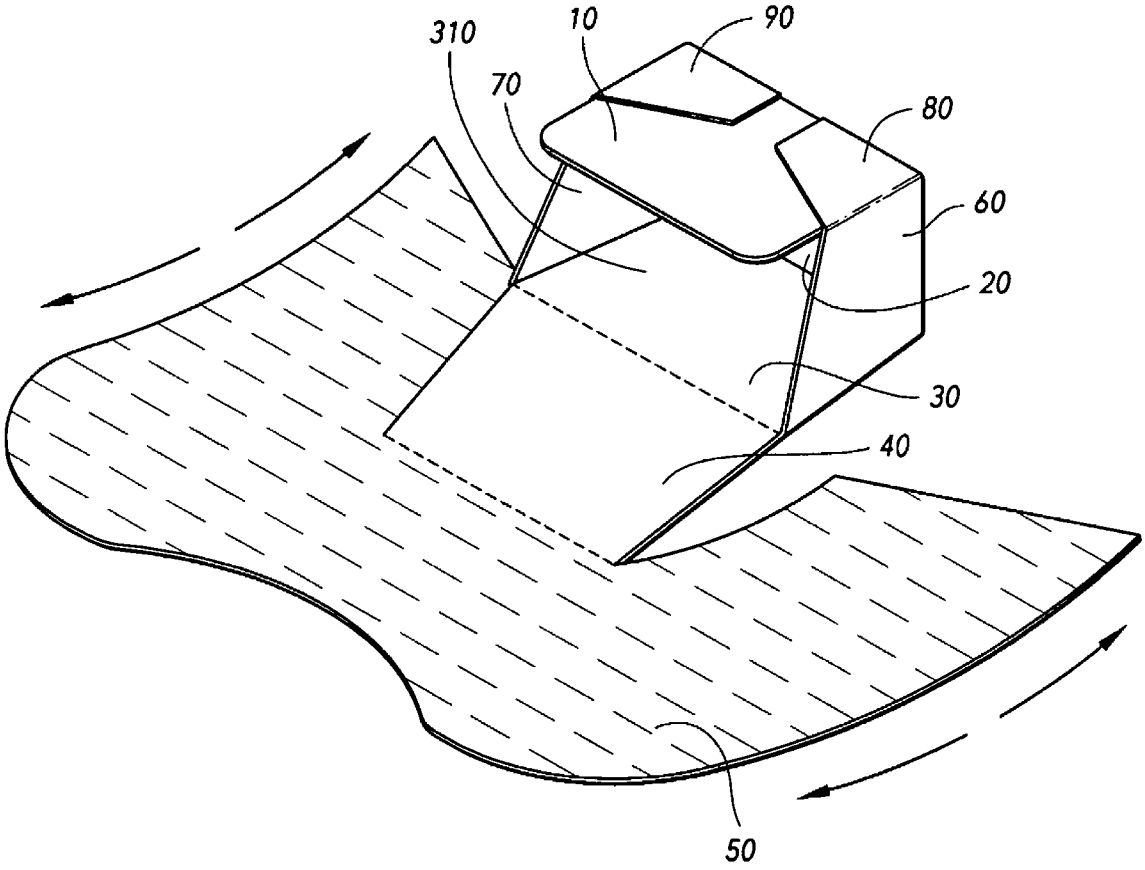
FIG. 3 illustrates a perspective view of the food holder with the sides folded to create a holding receptacle for a food item according to some embodiments.
Figure 4:
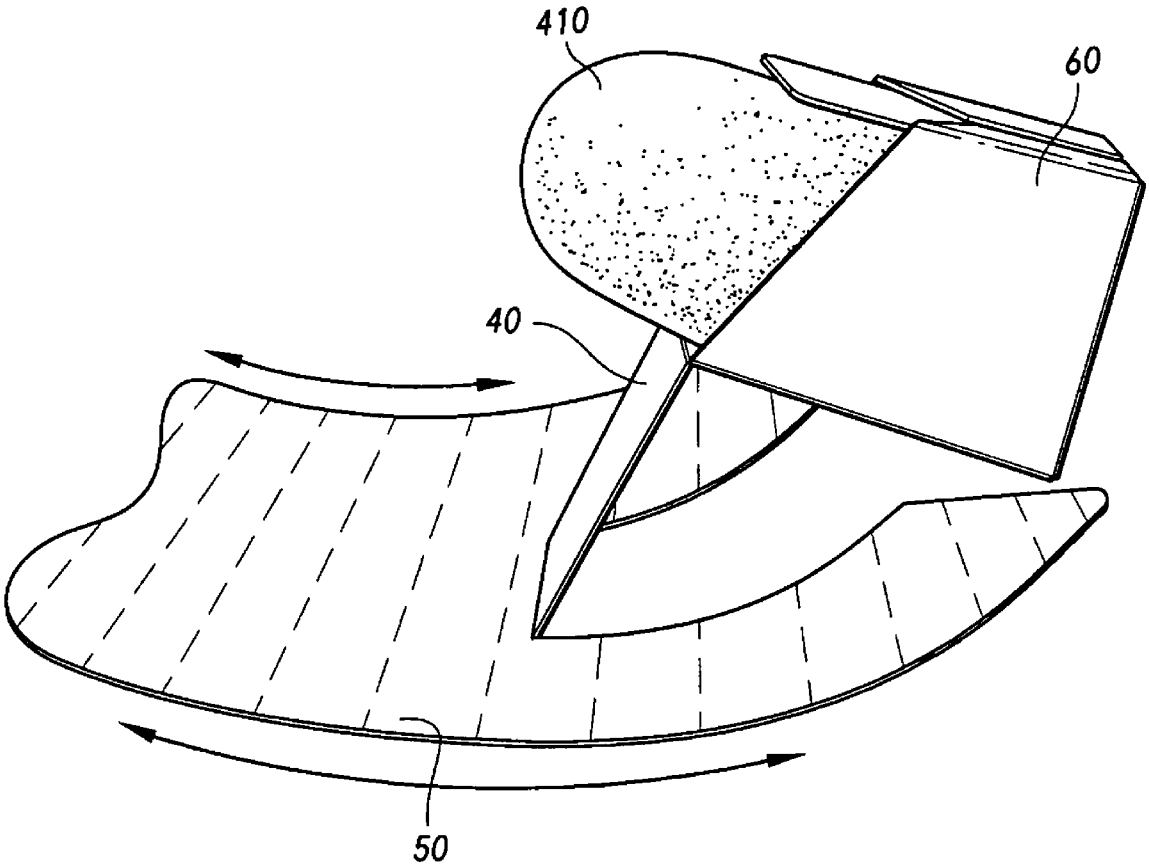
FIG. 4 illustrates a perspective of the food holder with a food item inserted in the holding receptacle in some embodiments.

FIG. 3 illustrates another perspective view of the food tray after the side panels are folded. As shown, flaps 80 and 90 are located on the outside of side panel 10. In some embodiments, flaps 80 and 90 are glued to side panel 1. In some embodiments, flaps 95 and 97 (shown in FIG. 5) are glued to back panel 20. After folding is completed, panels 10, 20, 30, 60, and 70 create a cavity or holding receptacle 310 for holding a food item. Flaps 80, 90, 95, and 97 would be on the outside of the receptacle (as opposed to the food item that would be located inside the receptacle). FIG. 4 illustrates the food holder of some embodiments with a food item 410 inserted in the food receptacle.

To facilitate transportation of the food holder from an assembly location to a fast food place or restaurant, the food holders are stacked up by placing a food holder on top of another food holder in a way that the holding receptacle 310 of the top food holder is inserted inside the holding receptacle of the bottom food holder. In some embodiments, some of the side panels 10, 30, 70 and 80 form angles that are wider than 90 degrees (e.g., 100, 105, 110 degrees, etc.) relative to the back panel to facilitate stacking up of the food holders.

Figure 5:
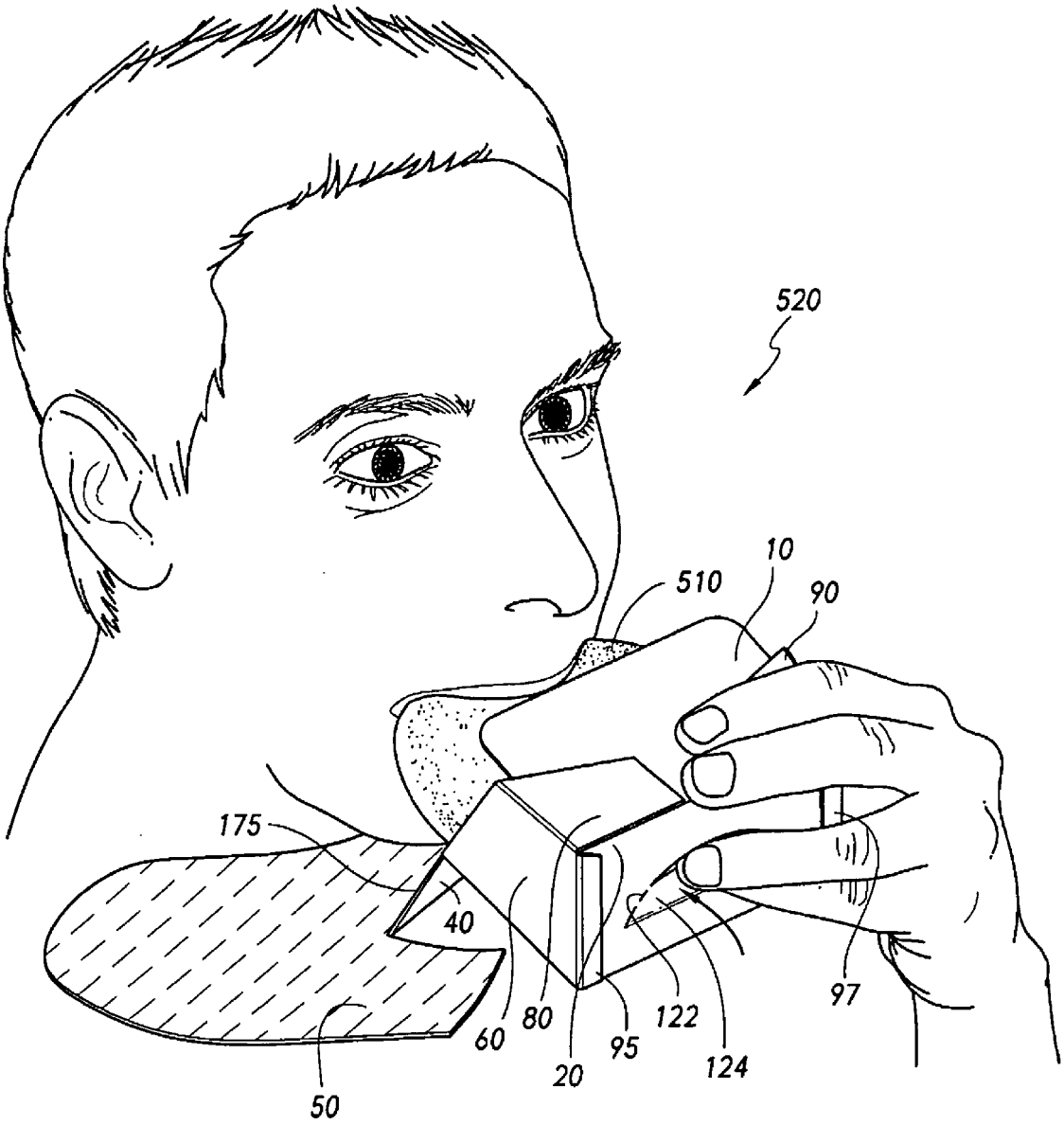
FIG. 5 illustrates a consumer holding a food item with the food item inserted in it according to some embodiments of the invention.
Figure 6:
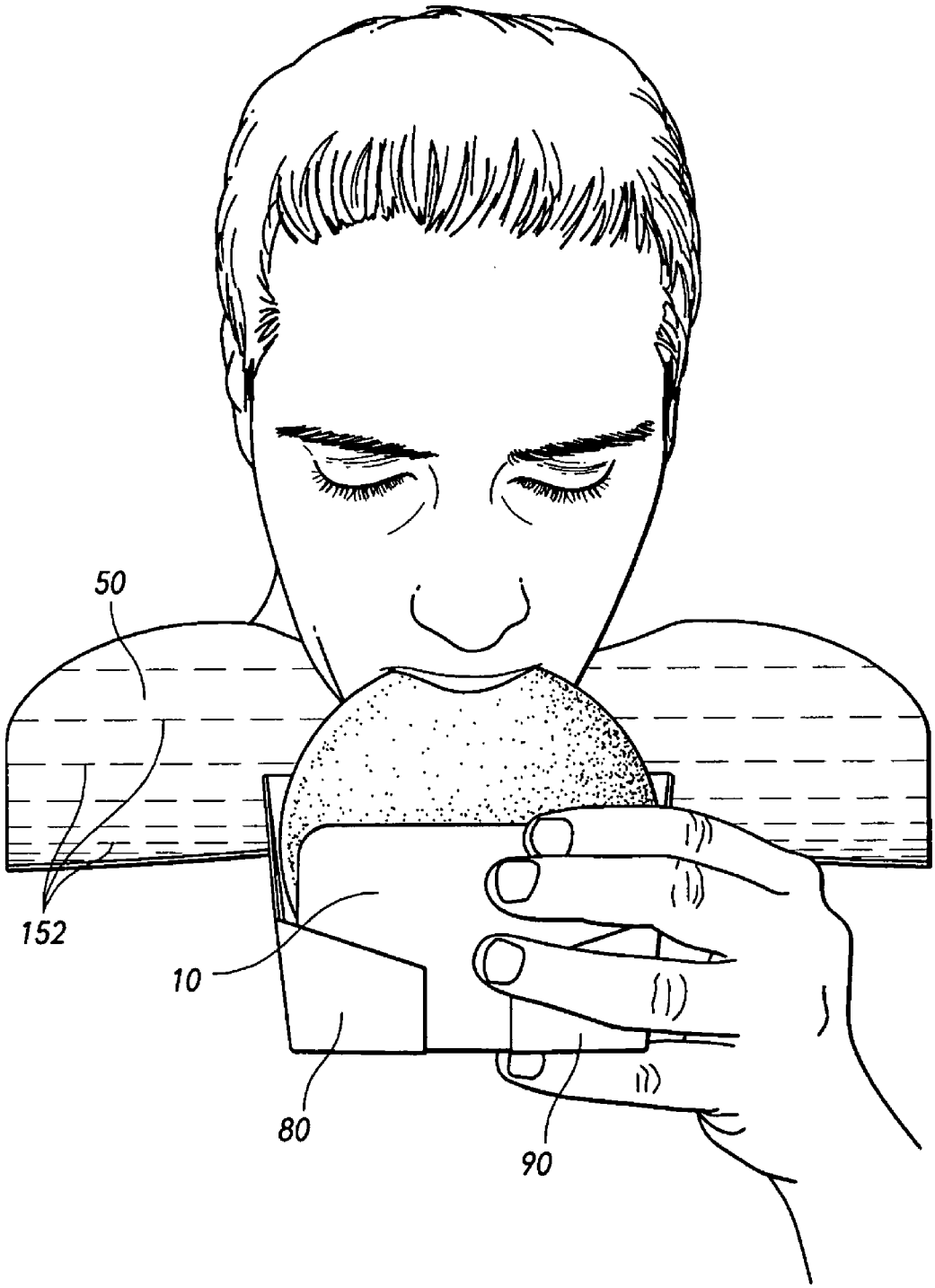
FIG. 6 illustrates a consumer holding a food item with the food item inserted in it according to some embodiments of the invention.

FIGS. 5 and 6 illustrate the food holder with a food item 510 inserted in it according to some embodiments of the invention. A consumer 520 can hold the food holder with either one or both hands. One way to hold the food holder by a right handed person is to place the index and/or the middle finger on panel 10 and the thumb on panel 30. In this position, panel 60 will be in the palm of the consumer. Similarly, one way to hold the food holder by a left handed person is to place the index and/or the middle finger on panel 10 and the thumb on panel 30. In this position, panel 70 will be in the palm of the consumer.

As can be appreciated from FIGS. 5 and 6, the food item does not touch the hand of the consumer 510. In some embodiments, the cut 122 on the back panel 20 allows a portion 124 of back panel 20 to be pushed inside against the food item 510. As the food item 510 is being eaten, the consumer 520 presses with the ring or small finger against back panel 20 to open portion 124 to push the food item toward the opening of the holding receptacle and the consumer mouth.

Furthermore, as shown, the apron 50 is located below the chin and cheeks of the consumer so as to prevent the food pieces from spilling onto the consumer dress and body. Since apron 50 is connected to the rest of the food holder only through edge 175, the consumer can easily move his or her hand up and down without removing the apron from under the chin. Also, folds 152 cause flexibility in the apron while the food item is being eaten.

Figure 7:
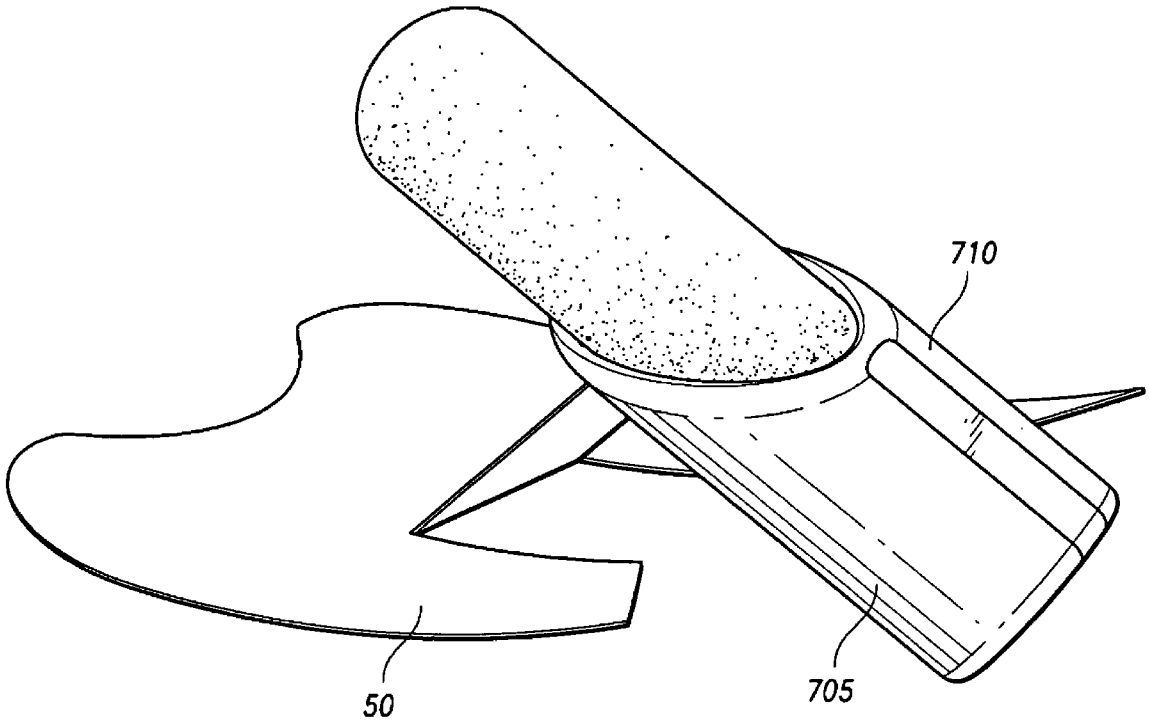
FIG. 7 illustrates the food holder according to an alternative embodiment of the invention.

The holding receptacle can be adapted to hold any food items such as burgers, sandwiches, pita sandwiches, wraps, hot dogs, tacos, burritos, etc. For instance, FIG. 7 illustrates the food holder according to another embodiment of the invention. In this embodiment, the holding receptacle forms a cylindrical shape for holding a food item such as a hot dog or any bread or tortilla rolled or folded around a filling such as a burrito. In this embodiment, the receptacle is formed by rolling the side 705 over 710 and gluing them together.

A person of ordinary skill in the art would realize that the holding receptacle can be shaped in other forms to hold different kind of food items. For instance, in some embodiments the holding receptacle can have a V shape to hold a food item such as a taco. In these embodiments, the two side panels 70 and 80 form angles that are wider than 90 degrees (e.g., 100, 120, 140 degrees, etc.) relative to the back panel to form a V shape receptacle.

Food holder can be made of any flexible material such as regular cardboard, grease resistances cardboard, recycled cardboard, plastic, hard paper, carton, or similar items. In some embodiments, the foldable lines (such as line 155) are hinge scored or creased to facilitate folding of the panels and flaps against each other. In some embodiments, where the food holder is made of plastic, Styrofoam, or the like, the food holder is not assembled by folding and gluing as described above. Instead, the food holder may be made through an injection molding or vacuum forming process. The food holder can be advantageously used in restaurants to dispense sandwiches, hamburgers, hotdogs, burritos, tacos, pita sandwiches, submarine, and the like.

Alternative Embodiments

Figure 8:
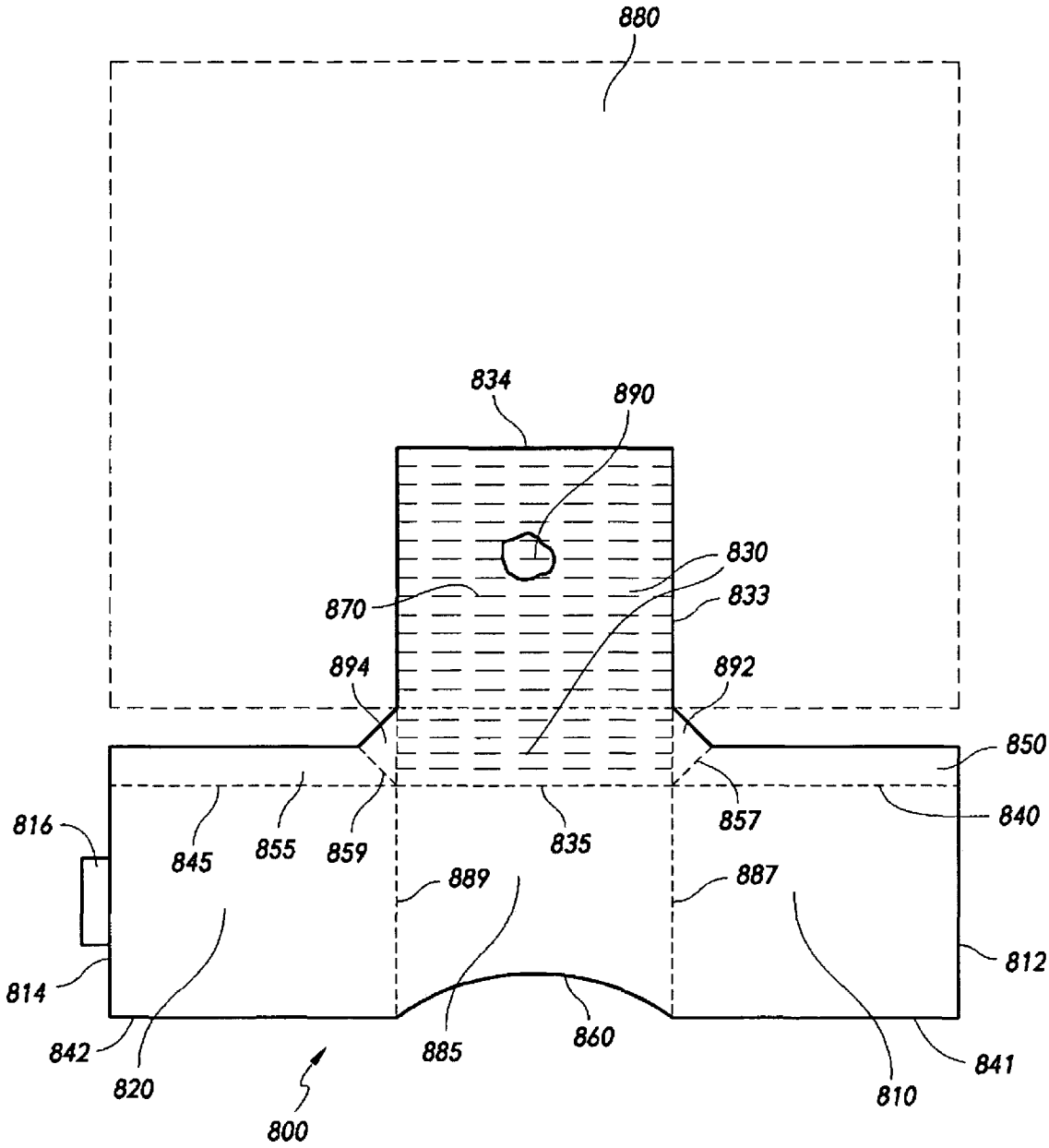
FIG. 8 illustrates a two dimensional view of the food holder according to some embodiments of the invention.

In some embodiments, the food holder is combined with a box that can be used as both a food holder and a food tray. The disclosed food holder prevents direct contact of the food items with the hands of a consumer and prevents the food to spill on the consumer clothes. The food holder acts as a food wrapper before the food is being consumed and as an apron while the food is being consumed. FIG. 8 illustrates a two dimensional view of a food holder 800 according to some embodiments of the invention. As shown, the food holder 800 includes walls (or side panels) 810 and 820, base (or back panel) 830, midsection 885, and flaps 850, 855, 892, and 894. In some embodiments, wall 810 is separated from the midsection 885 by one or more crease lines 887 and wall 820 is separated from midsection 885 by one or more crease lines 889 to facilitate folding. In other embodiments, walls 810 and 820 and midsection 885 are connected to each other without crease lines. In some embodiments, flaps 850 and 855 are separated from the walls 810 and 820 by crease lines 840 and 845, respectively, to facilitate folding of these flaps toward the wall. Some embodiments include one or more crease lines 857 between flaps 850 and 892, and include one or more crease lines 859 between flaps 855 and 894 to facilitate folding of the flaps towards the base 830. The two symmetrical flaps 892 and 894 act as "edges" between the walls and the base and prevent the food particles in any form of solid, semi-liquid or liquid from spilling out of the seams between base and the walls. In some embodiments flaps 892 and 894 are triangle shape. In some embodiments, there are one or more crease lines 835 between base 830 and midsection 885 to facilitate folding of the base and the midsection towards each other.

Some embodiments include an optional wrapping paper 880 and optional glue 890 to attach the wrapping paper to the base 830. In some embodiments, midsection 885 includes an optional chin curve 860 to facilitate eating the food contained in the food holder. In some embodiments, the chin curve is an arcuate cut to facilitate placing the food holder under the chin of the food item consumer. In some embodiments, the chin curve 860 is formed as a paper rolled rim (similar to the rim of some paper coffee cups) to place under the chin of the consumer to prevent any scratch to the chin of the consumer. In some embodiments, the rolled rim is an outgrowth to the chin curve while other embodiments use a rubber or plastic part attached to the chin curve to provide safety for the chin of the consumer.

The chin curve has different sizes in different embodiments. For instance, the chin curve can be cut of a part of the side of the midsection that is opposite to crease line 835, the chin curve can be the same size as the side of the midsection (as shown in FIG. 8), smaller than the side of the midsection, or larger than the side of the midsection in a way that parts of the chin curve is cut from the side of walls 810 and 820 which are opposite to crease lines 840 and 845, respectively.

Midsection 885 and base 830 have different proportional dimensions in different embodiments. For instance, in some embodiments, side 833 (the length between side 834 and crease line 835) of base 830 is longer than side 812 (the length between crease line 840 and side 841) of wall 810 or side 814 (the length between crease line 845 and side 842) of wall 820. In other embodiments, the side 834 of base 830 is wider than crease lines 840 or 845.

Figure 15:
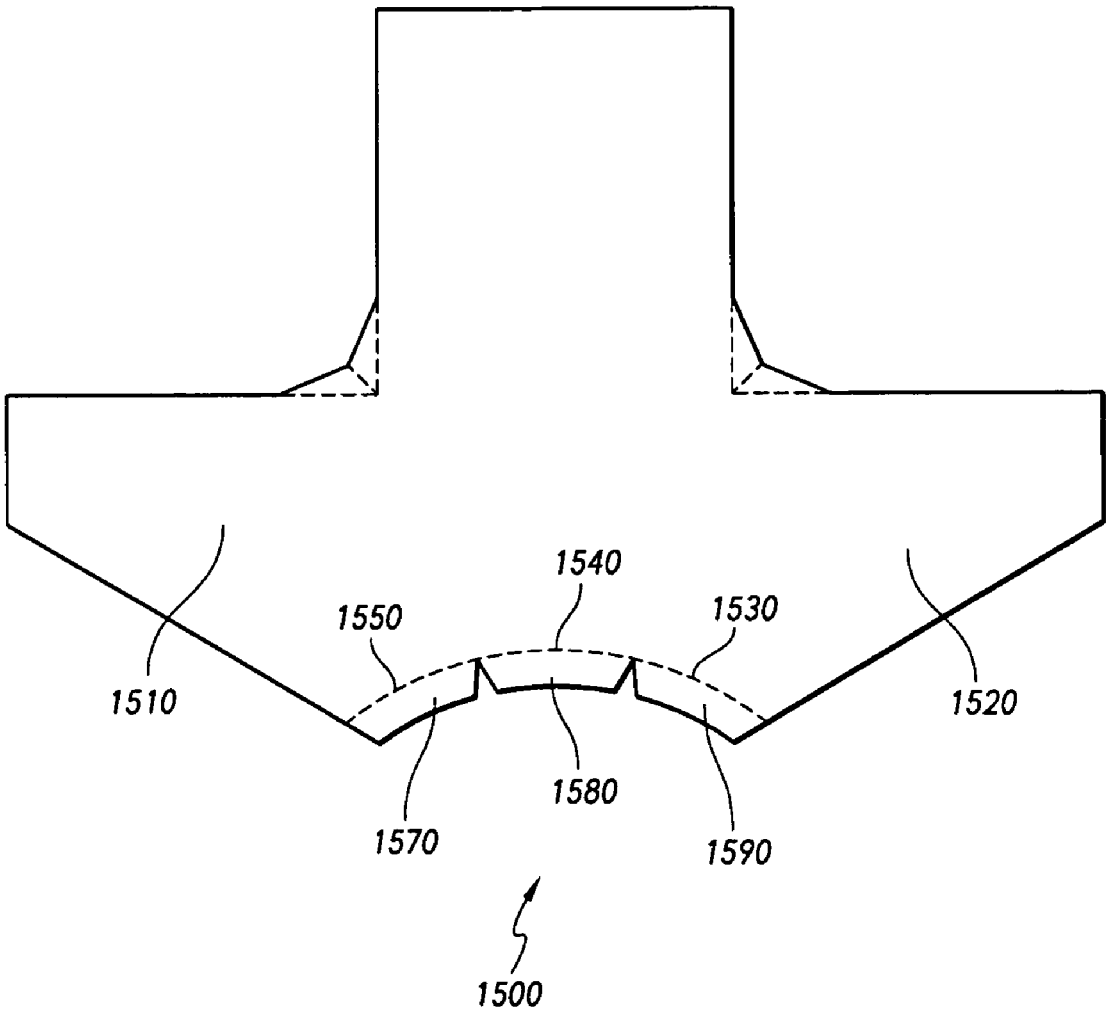
FIG. 15 illustrates the food holder of some embodiments with trapezoidal shape walls and segmented chin curve.

Some embodiments use trapezoid shape walls. FIG. 15 illustrates a food holder 1500 of some embodiments. As shown, walls 1510 and 1520 of food holder 1500 are trapezoidal shape. Furthermore, chin curve is divided into two or more segments (three segments 1570, 1580, and 1590 are shown). Segments 1570, 1580, and 1590 are separated from the rest of the food holder by crease lines 1550, 1540, and 1530 respectively to facilitate bending of the segments. Each crease line shown in FIG. 15 can be one or more crease lines. The segmented chin curve facilitates placing the chin holder under the chin of consumer and prevents scratching or injuring the consumer's face.

Figure 16:
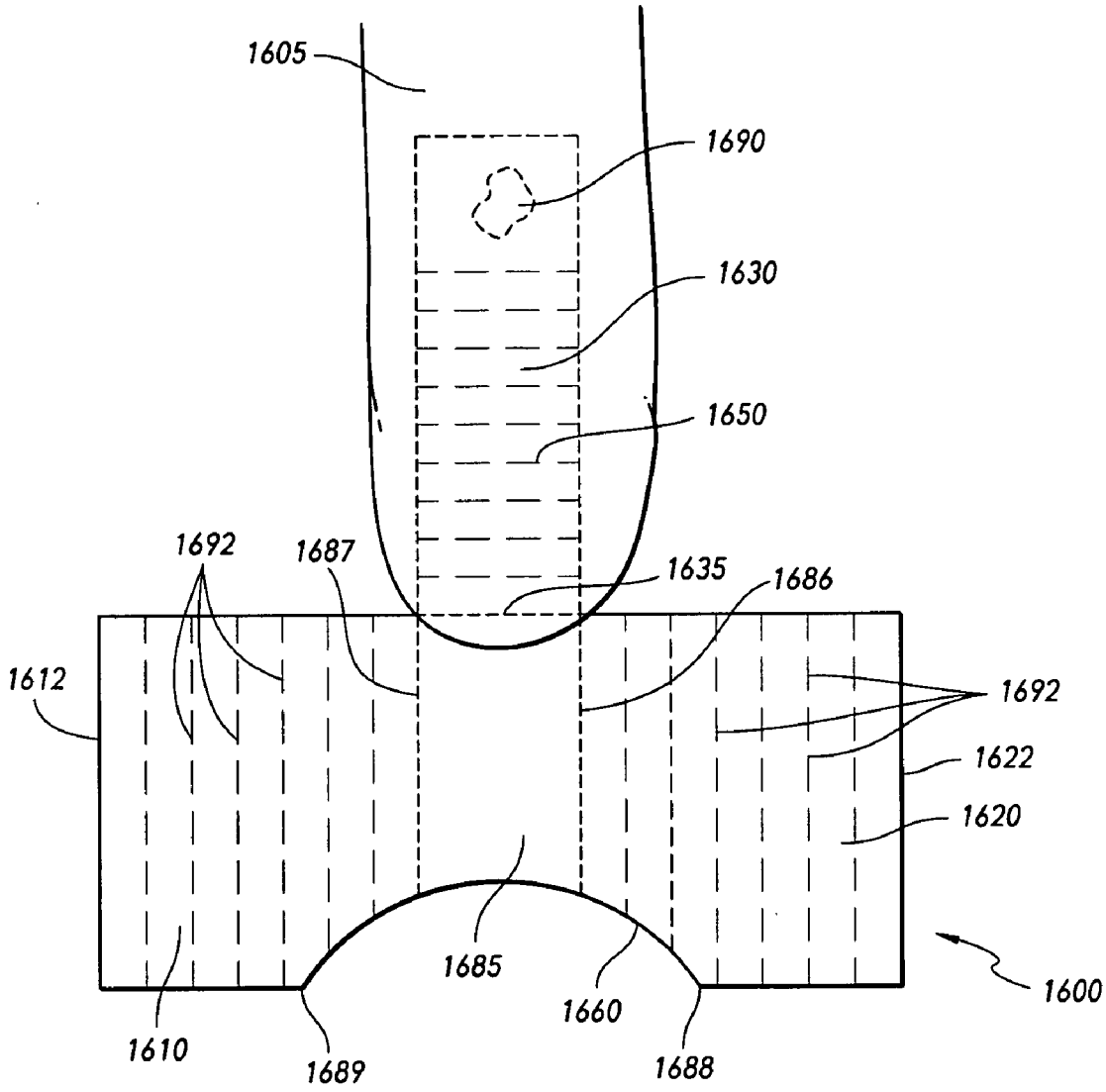

Some embodiments are used for the long round base food items (such as hotdog or burrito). Some of these embodiments have a narrower and shorter base than the food holder shown in FIG. 8. FIG. 16 illustrates a food holder 1600 of some embodiments for holding a food item 1605. As shown, the food holder includes a base 1630, midsection 1685, and walls 1610 and 1620. Similar to the food holder shown in FIG. 8, base 1630 is optionally attached to a wrapping paper using optional glue 1690. The optional wrapping paper is not shown for simplicity. Some embodiments include the optional chin curve 1660.

In some embodiments, the chin curve 1660 is wider than the width of the midsection 1685 and (as shown in FIG. 16) is partially cut from sides of walls 1610 and 1620. As shown, the chin wrapper in FIG. 16 spans from point 1689 on wall 1610 to point 1688 on wall 1620. In other embodiments, the chin curve is the same width or smaller that the width of the midsection. In some embodiments, the chin curve 1660 is formed as a paper rolled rim (similar to the rim of some paper coffee cups) to place under the chin of the consumer to prevent any scratch to the chin of the consumer. In some embodiments, the rolled rim is an outgrowth to the chin curve while other embodiments use a rubber or plastic part attached to the chin curve to provide safety for the chin of the consumer. Similar to the embodiments shown in FIG. 15, chin curve 1660 can be divided into two or more segments (not shown). In some embodiments, these segments are separated from the rest of the food holder by one or more crease lines to facilitate bending of the segments.

In some embodiments, walls 1610 and 1620 include one or more crease lines 1692 that are substantially parallel to sides 1612 and 1622 to facilitate folding of the walls towards the midsection 1685. In some embodiments, base 1630 includes one or more crease lines 1650 to facilitates folding of the base. In some embodiments, midsection 1685 is separated from walls 1610 and 1620 by one or more crease lines 1687 and 1686 to facilitate folding of the walls towards the midsection. Similarly, midsection 1685 is separated from base 1630 by one or more crease lines 1635 to facilitate folding of the midsection and the base towards each other.

Figure 20:
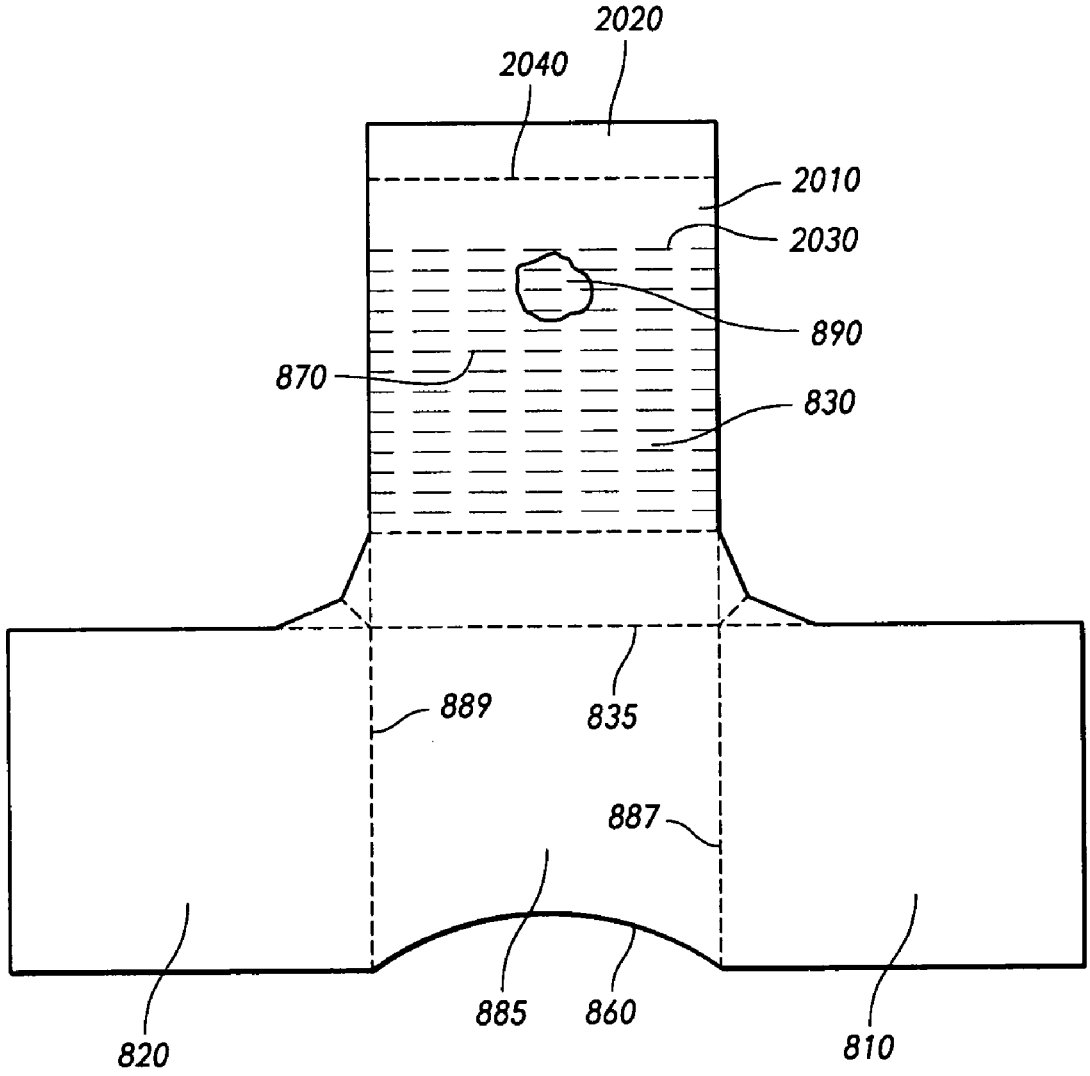
FIG. 20 illustrates a two dimensional view of the food holder that includes a lid according to some embodiments of the invention.

FIG. 20 illustrates an embodiment that includes a lid. As shown, the lid includes two sections 2010 and 2020. Section 2010 folds through the creasing line 2030 and section 2020 folds through the creasing line 2040 to form a lid for the food holder. The lid covers an opening between base (back panel) 830 and midsection 885 to make the food holder to wrap around the food item. Other details of FIG. 20 are similar to FIG. 8 which are described above.

Wrapping the Food Item

Referring back to FIG. 8, in order to wrap the food item, the food item is wrapped in the wrapping paper 880 (or is placed against base if the food holder does not include the optional wrapping paper and glue) in some embodiments. Walls 810 and 820 are then folded towards each other while flaps 850 and 855 are folded through the crease lines 840 and 845 towards the walls 810 and 820 respectively. Flaps 850 and 855 are further folded towards the base through the crease lines 857 and 859 respectively. In some embodiments, base 830 optionally includes crease lines 870 to facilitate folding of the base 830 to wrap around the food item.

In some embodiments, an optional tape 816 then attaches the two sides 812 and 814 of walls 810 and 820 together. Tape 816 can be placed on either side 812 of wall 210 or side 814 of wall 820. In some embodiments, the tape is a food grade tape. Some embodiments include an optional paper lock (not shown) to attach the two sides 812 and 814 of the walls. The lock can be in the form of a cut on a wall and a tab on the other wall. The paper lock can also be any type of male-female lock that could keep the two walls attached together.

Figure 9:
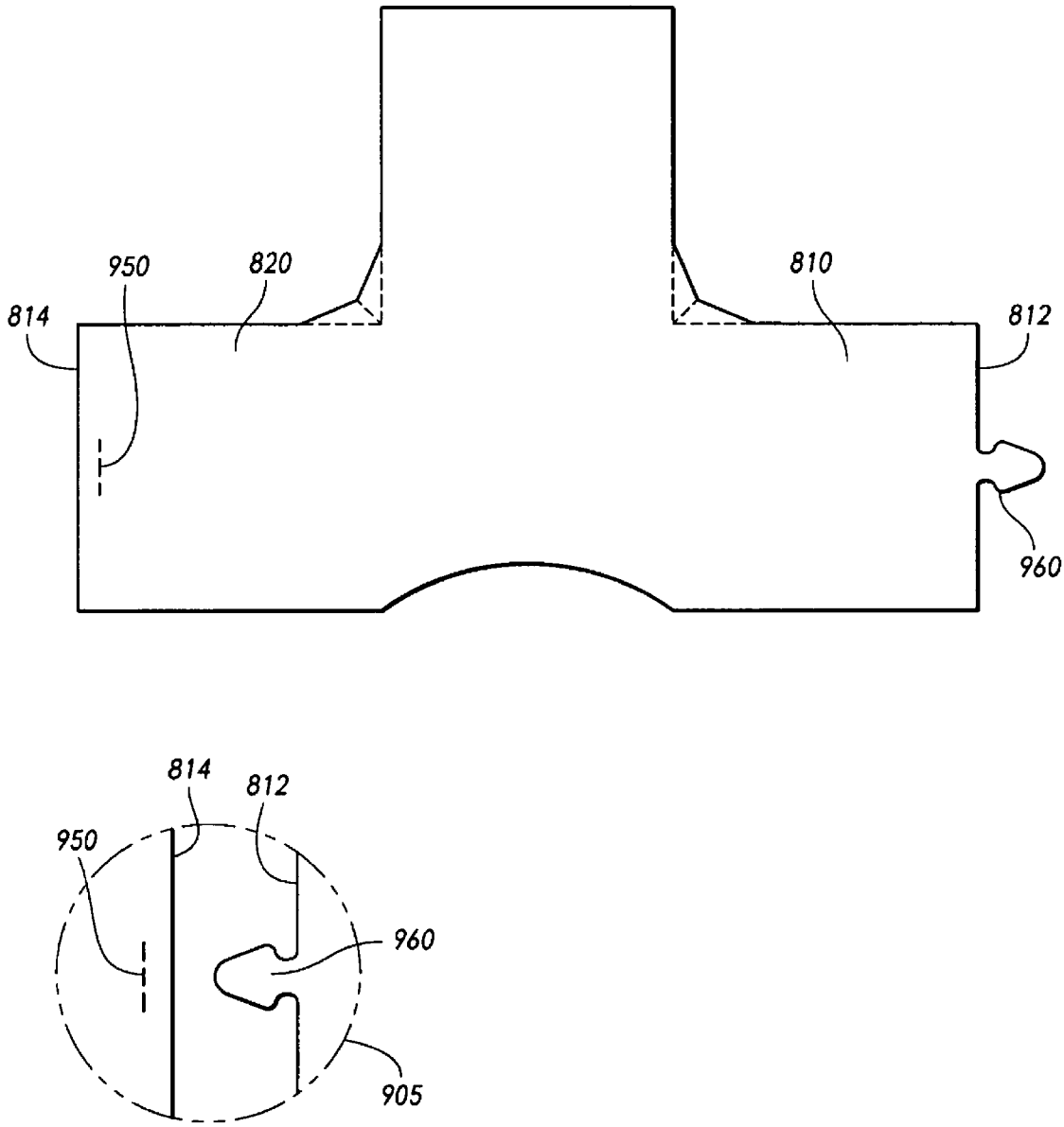
FIG. 9 illustrates a food holder that includes a paper lock in some embodiments.

FIG. 9 illustrates a food holder that includes a paper lock in some embodiments. As shown, one of the walls includes a latch (or tab) 960 while the other wall includes a fissure (or cut) 950. Further details of the paper lock are shown in the magnified view 905. When walls 810 and 820 are folded towards each other, latch 960 passes through fissure 950, which is narrower than the high width 865 of latch 860.

Figure 10:
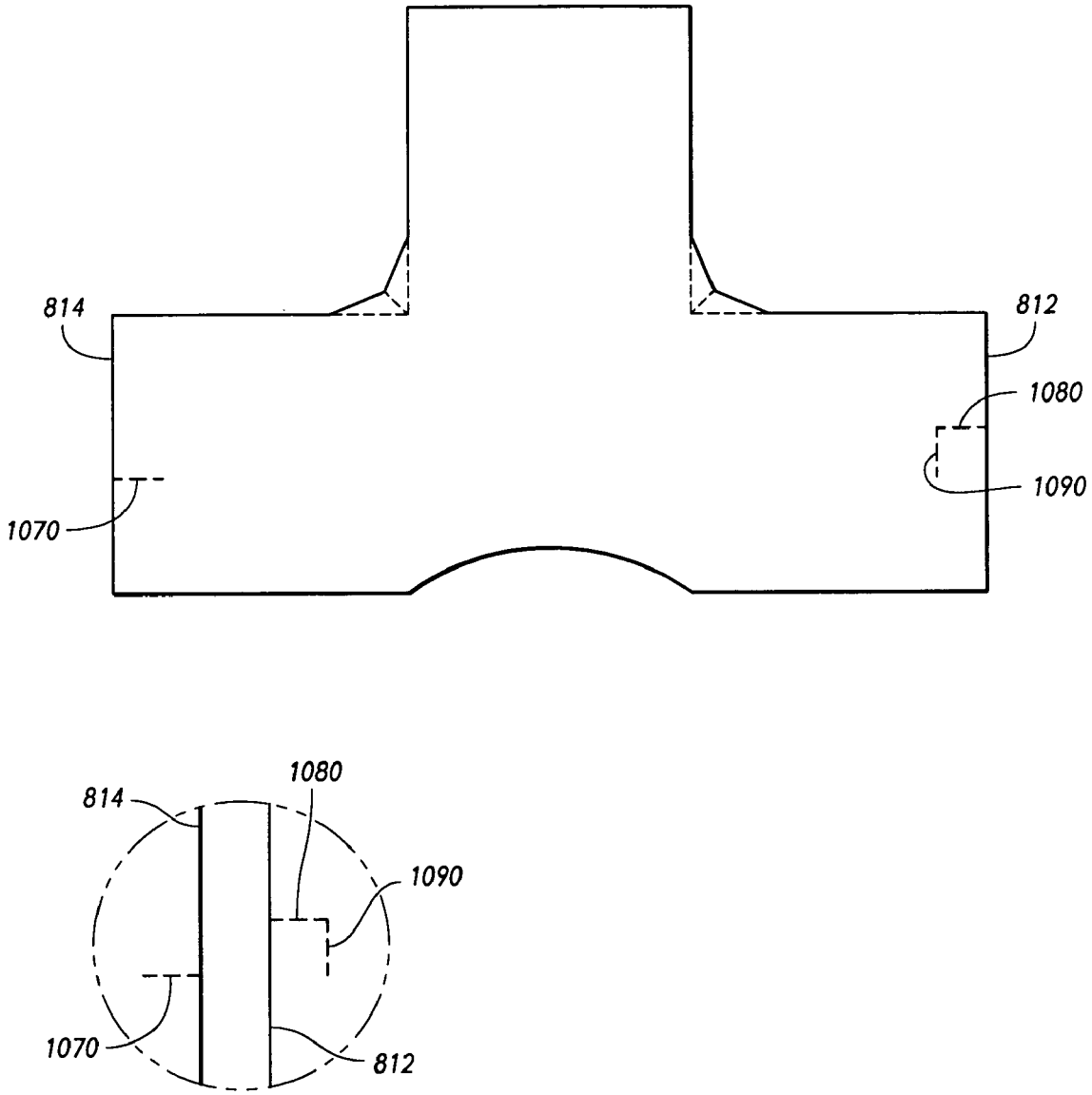
FIG. 10 illustrates a food holder that includes a paper lock in some embodiments.

FIG. 10 illustrates another embodiment of the food holder with a different type of paper lock. As shown, one of the walls includes one cut (or fissure) 1070 while the other wall includes two cuts (or fissures) 1080 and 1090. During folding, fissure 1070 goes inside the fissure 1080 and slides into fissure 1090 in order to lock the two walls together.

Figure 11:
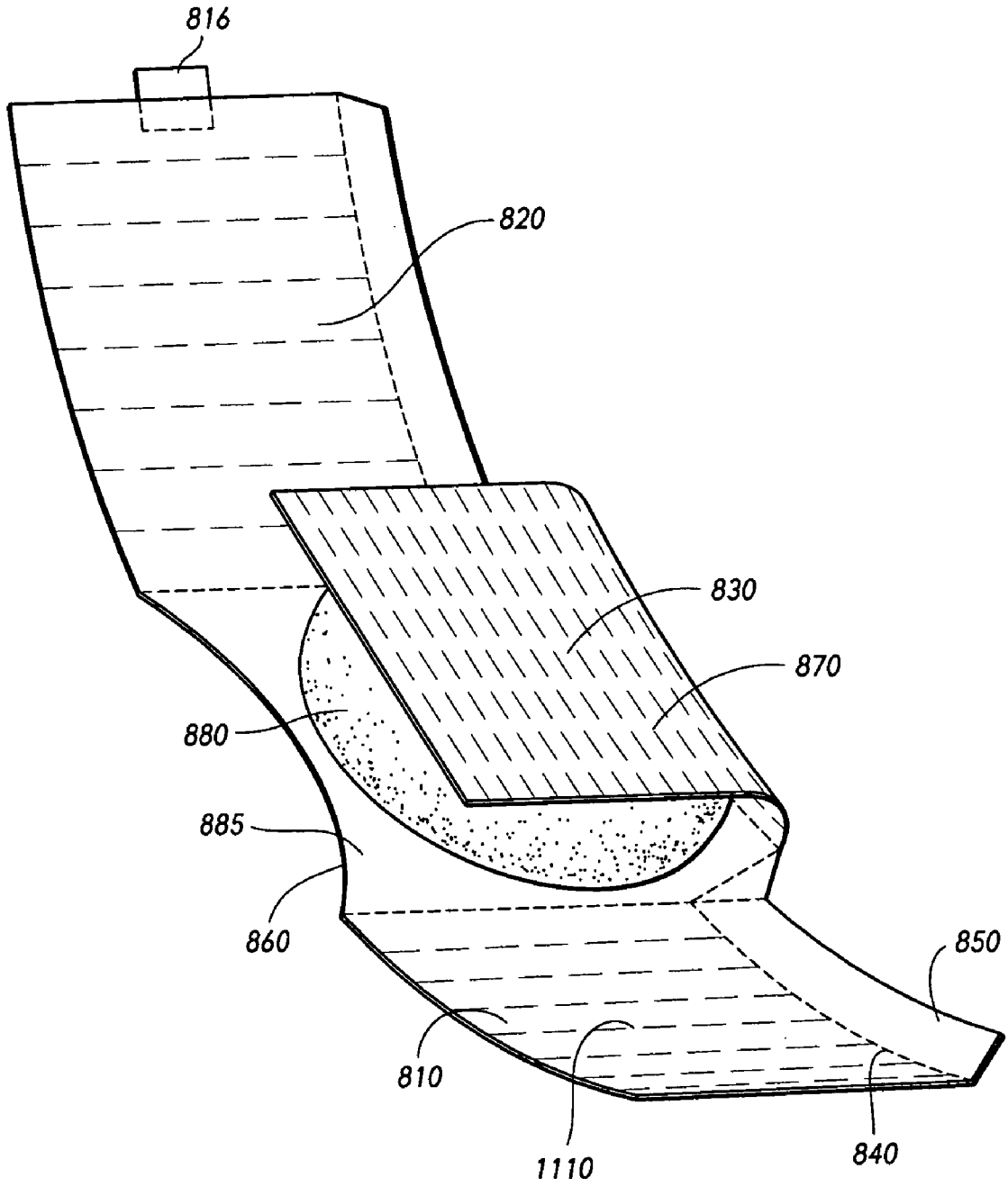
FIG. 11 illustrates a perspective view of the food holder according to some embodiments.

FIG. 11 illustrates another perspective view of the food holder after base 830 is folded. As shown, a food item is placed inside the wrapping paper 880. As described above, the wrapping paper includes an optional wrapping paper, which is glued to base 830 in some embodiments. The optionally wrapped food item is then placed between midsection 885 and base 830. Walls 810 and 820 are folded towards each other and get attached through the tape 816 or the paper lock (not shown).

It should be obvious to a person of ordinary skill in the art that the folding of different parts of the food holder can be done in different order. For instance, the food item wrapped in the wrapping paper can be placed between the base and midsection and then the walls can be folded towards each other. Alternatively, the walls can be partially folded towards each other prior to folding the base towards the midsection. In some embodiments base 830 is long enough (not shown) to stretch towards the chin curve 860 to fully wrap around the food item. In some embodiments, the walls includes mild crease lines (1110) that are substantially parallel to each other and go substantially across walls 810 and 820 and facilitate the curvy shape of an apron while eating. In some embodiments a wire or any similar element might be used to facilitate the forming of the apron and create flexibility.

Figure 12:
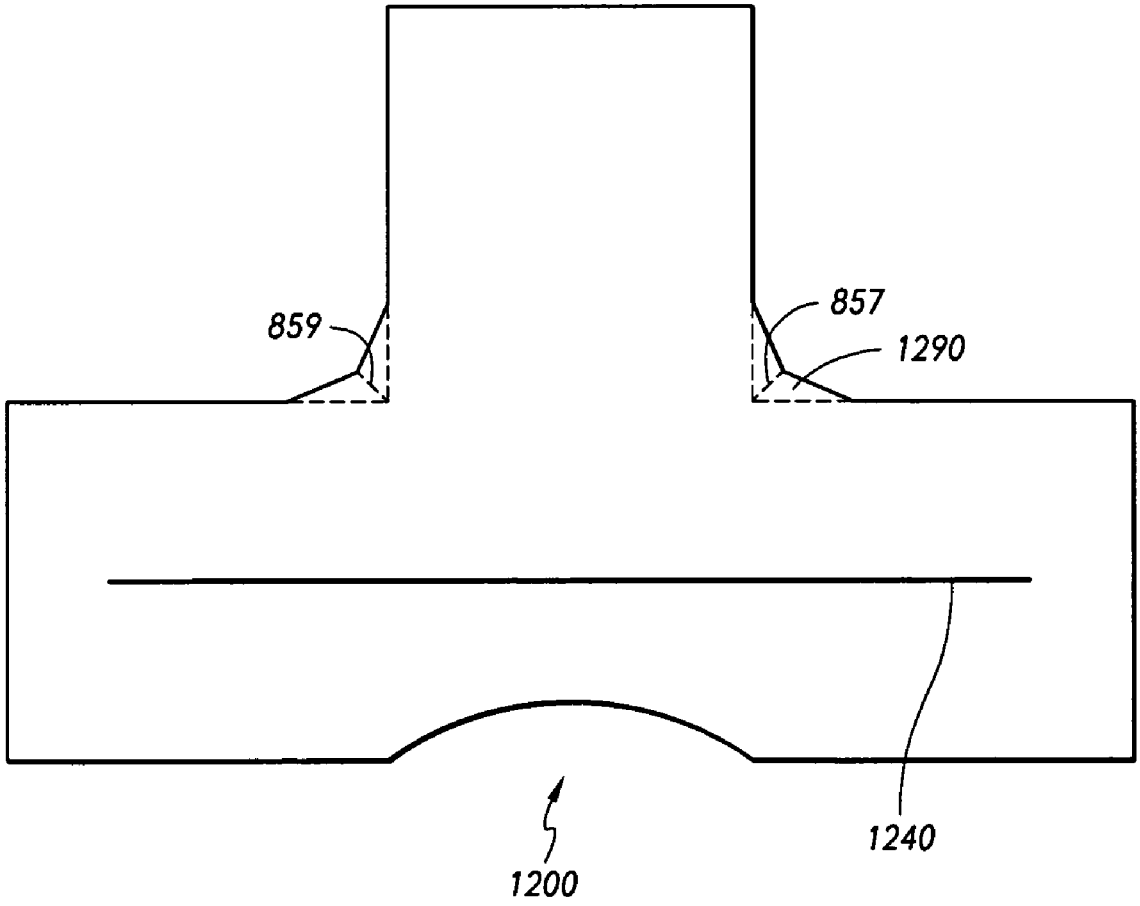
FIG. 12 illustrates a top view of food holder of some embodiments that includes a wire to help bending the walls.

FIG. 12 illustrates a top view of food holder 1200 of some embodiments. As shown, wire 1240 is attached to the food holder to help bending the walls. The wire is attached to the bottom of the midsection via a paper strip, which is placed over the wire and glued to the bottom of the midsection or placed between the layers of the cardboard of the midsection. In some embodiments, flap 1290 is shaped as shown in FIG. 12 to block the spillage of the food. The crease lines 859 and 857 bend upward while closing the box and help the corner 1290 bend.

Figure 17:
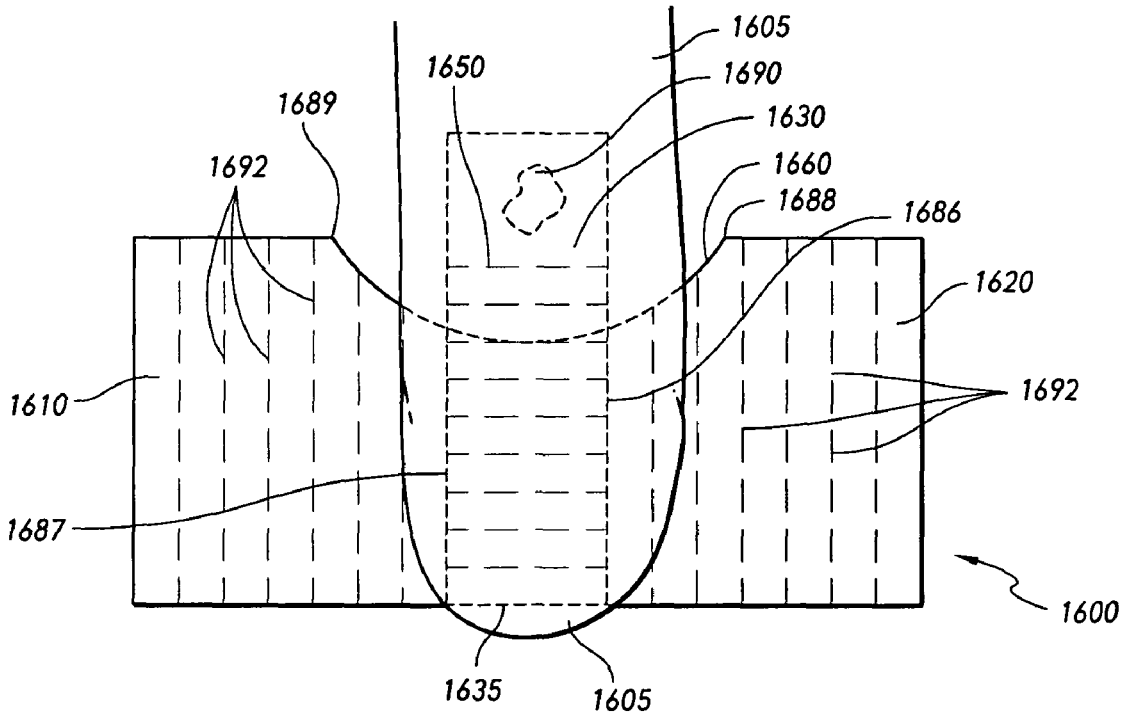
FIG. 17 illustrates the food holder of FIG. 16 after the midsection and side panels are folded behind the back panel.
Figure 18:
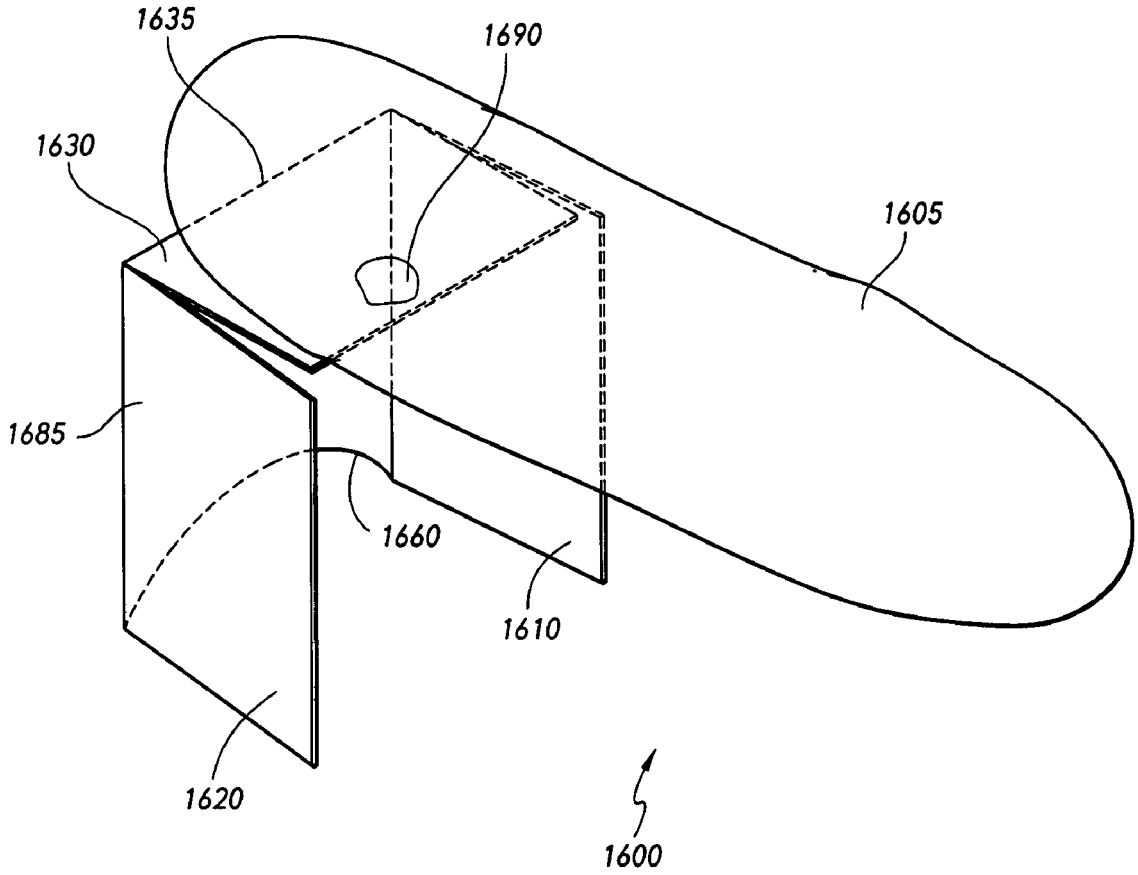
FIG. 18 illustrates a perspective view of the food holder of FIGS. 16 and 17 while the side panels and midsection are being folded.
Figure 19:
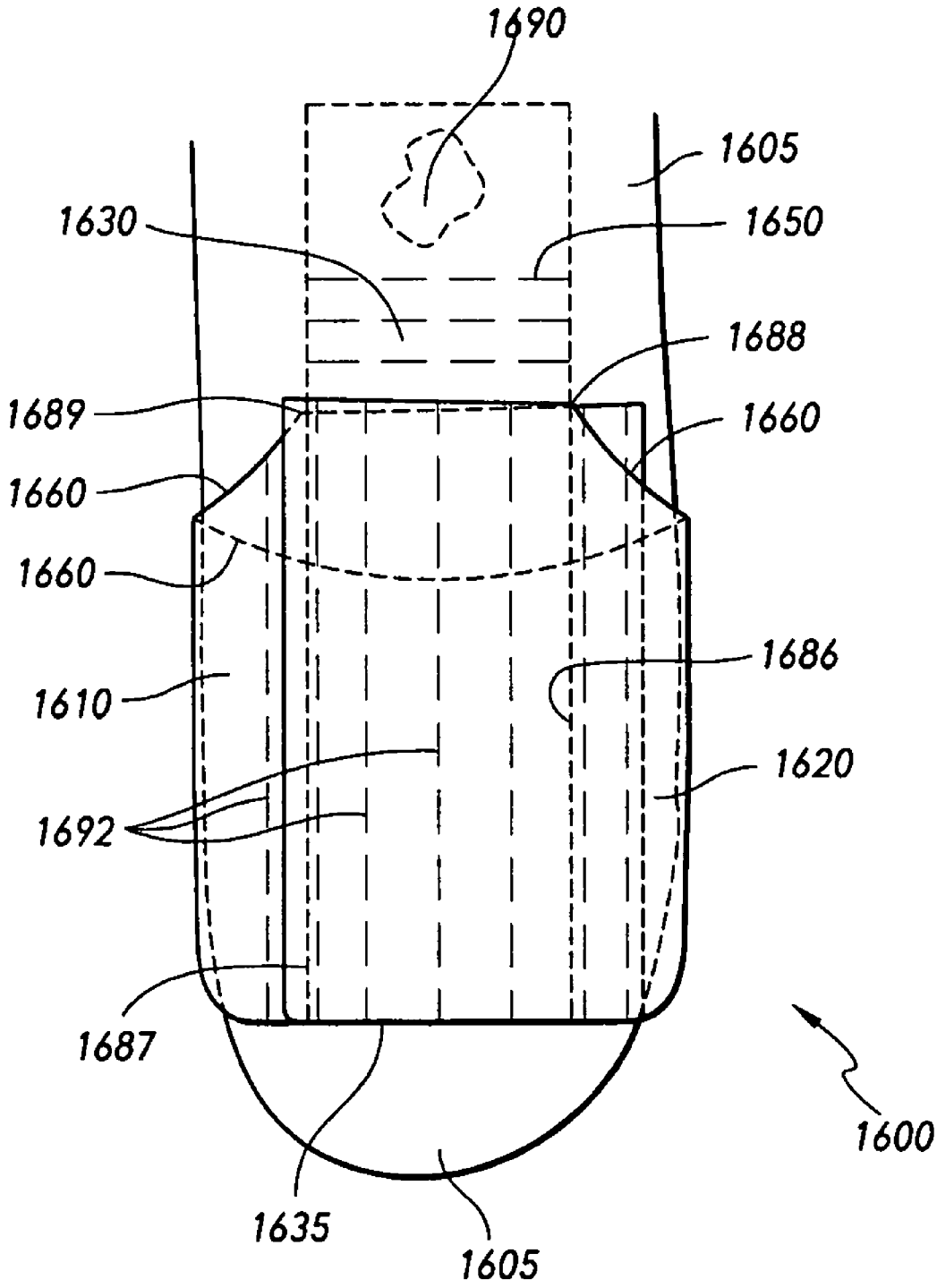
FIG. 19 illustrates a perspective view of the food holder of FIGS. 16-18 after the side panels are folded towards each other.

Referring to FIG. 16, similar steps can be used to wrap or place a food item in the food holder. FIG. 17 illustrates the food holder of FIG. 16 after the midsection and the walls for partially folded. Specifically, after wrapping the food item in the wrapping paper (or placing the food item against base 1630 if the food holder does not include wrapping paper), midsection 1685 and walls 1610 and 1620 are folded (along crease line 1635) behind the base on the opposite side of the food item. In other words, after this folding step, the base will be located between the food item and the midsection. On of the ordinary skill in the art would realize that instead of holding the food item and the base steady and folding the midsection and the walls behind the base, the midsection and the walls can be hold at their place and the food item and the base could be rotated to achieve the same result. Other ways of folding are also possible. For instance, FIG. 18 illustrates a perspective view of the food holder of FIG. 16. As shown, at the same time that the midsection is folded behind the base (in the side of the base that is farther from the food item), the walls are also being folded towards the midsection. FIG. 19 illustrates the food holder of FIG. 16 after the walls are folded towards each other to cover the side of food item 1605. Walls 1610 and 1620 are then attached to each other by a tape or paper lock similar to the embodiments described in FIGS. 8-10.

Figure 21:
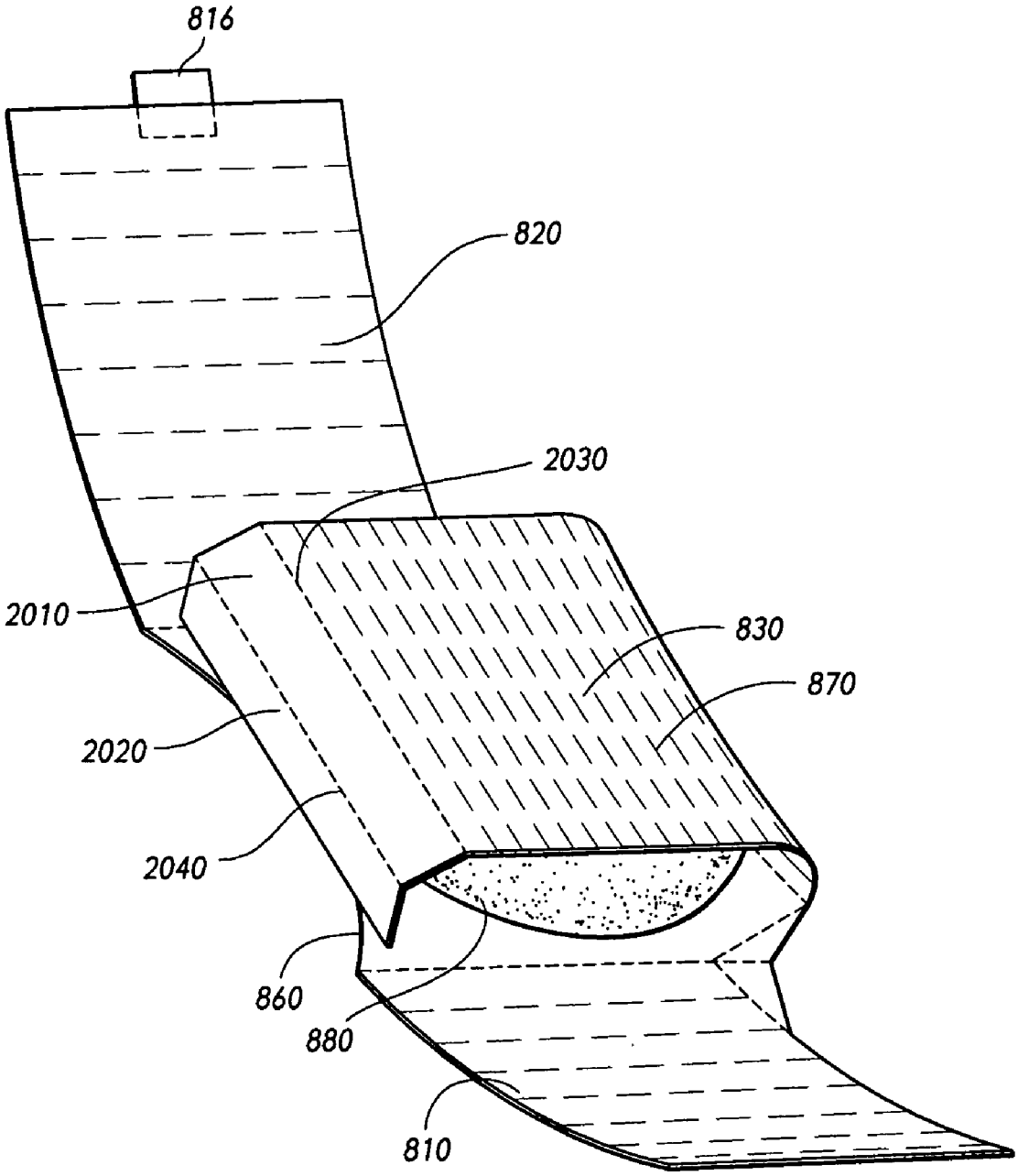
FIG. 21 illustrates a perspective view of the food holder of FIG. 20 after a food item is placed in the food holder and the back panel is folded towards the food item.

FIG. 21 illustrates a perspective view of the food holder of FIG. 20. As shown, the food item is wrapped in the optional wrapping paper 880 which is attached by glue 890 (shown in FIG. 20) to base 830. The base 830 is folded towards midsection 885. As shown, the two sections 2010 and 2020 of the lid are also folded across creasing lines 2030 and 2040 respectively. In some embodiments, either section 2020 or both sections 2010 and 2020 are placed under the food item (i.e., between the food item and midsection 885). Accordingly, base 830, lid sections 2010 and 2020, and midsection 885 wrap around the food item and the optional food wrapper to prevent spillage. Sections 810 and 820 are also folded towards each other. In some embodiments, sections 810 and 820 are taped together by the optional tape 816 or paper locks as described in conjunction with FIGS. 8-10, above.

Food holder can be made of any flexible material such as regular cardboard, grease resistances cardboard, recycled cardboard, plastic, hard paper, carton, or similar items. In some embodiments, the foldable lines (such as crease lines 840, 1550, or 1635) are hinge scored or creased to facilitate folding of the panels and flaps against each other. In some embodiments, where the food holder is made of plastic, Styrofoam, or the like, the food holder is not assembled by folding and gluing as described above. Instead, the food holder may be made through an injection molding or vacuum forming process. The food holder can be advantageously used in restaurants to dispense sandwiches, hamburgers, hotdogs, burritos, tacos, pita sandwiches, submarine, and the like.

Consuming the Food Item

Figure 13:
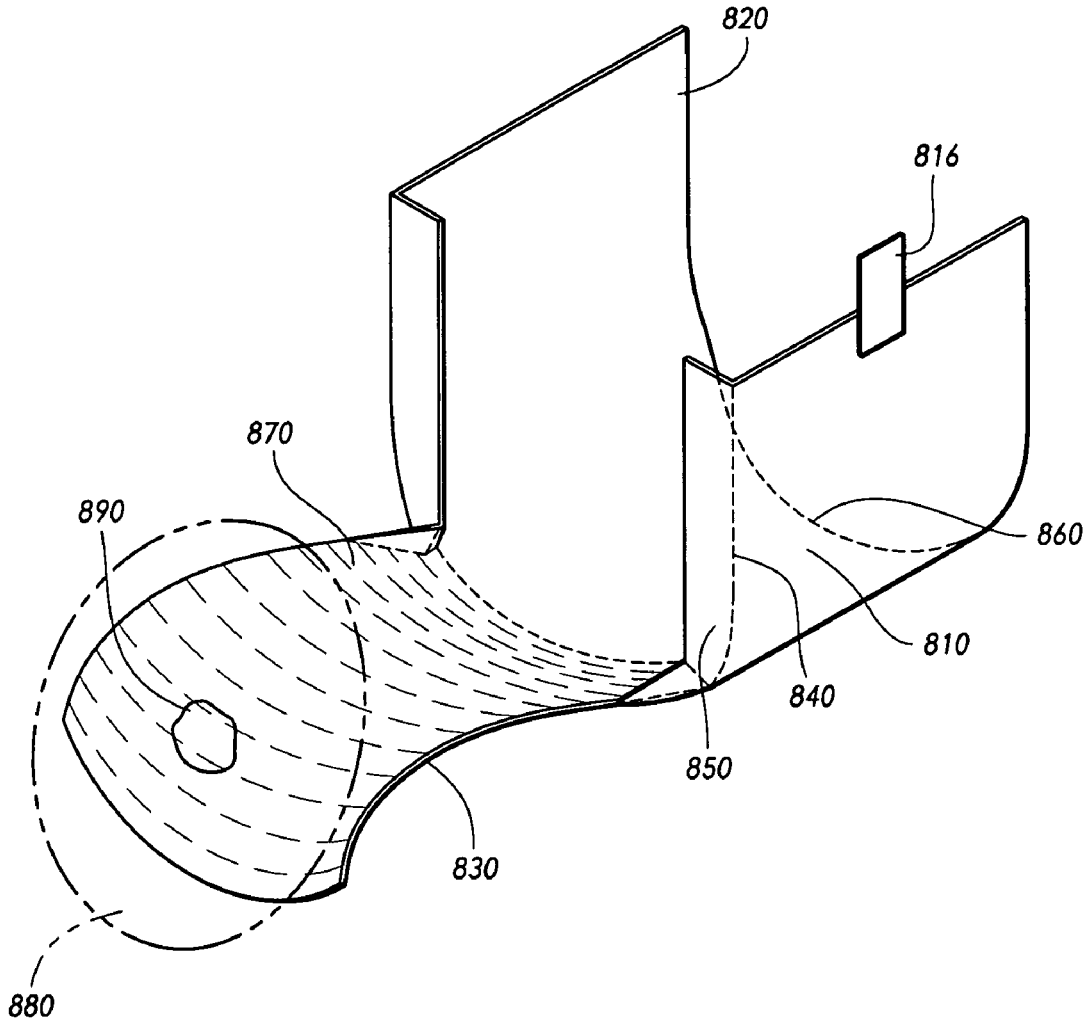
FIG. 13 illustrates a perspective view of the food holder of some embodiments after opening the walls.

In some embodiments, walls 810 and 820 are unfolded and, together with midsection 885, act as an apron during the consumption of the food item. FIG. 13 illustrates a perspective view of the food holder of some embodiments. This figure shows the food holder after opening walls 810 and 820. As shown, the food item is wrapped in wrapping paper 880 which is attached by glue 890 to base 830. Crease lines 870 on the base, facilitate unfolding of base 830.

Figure 14:
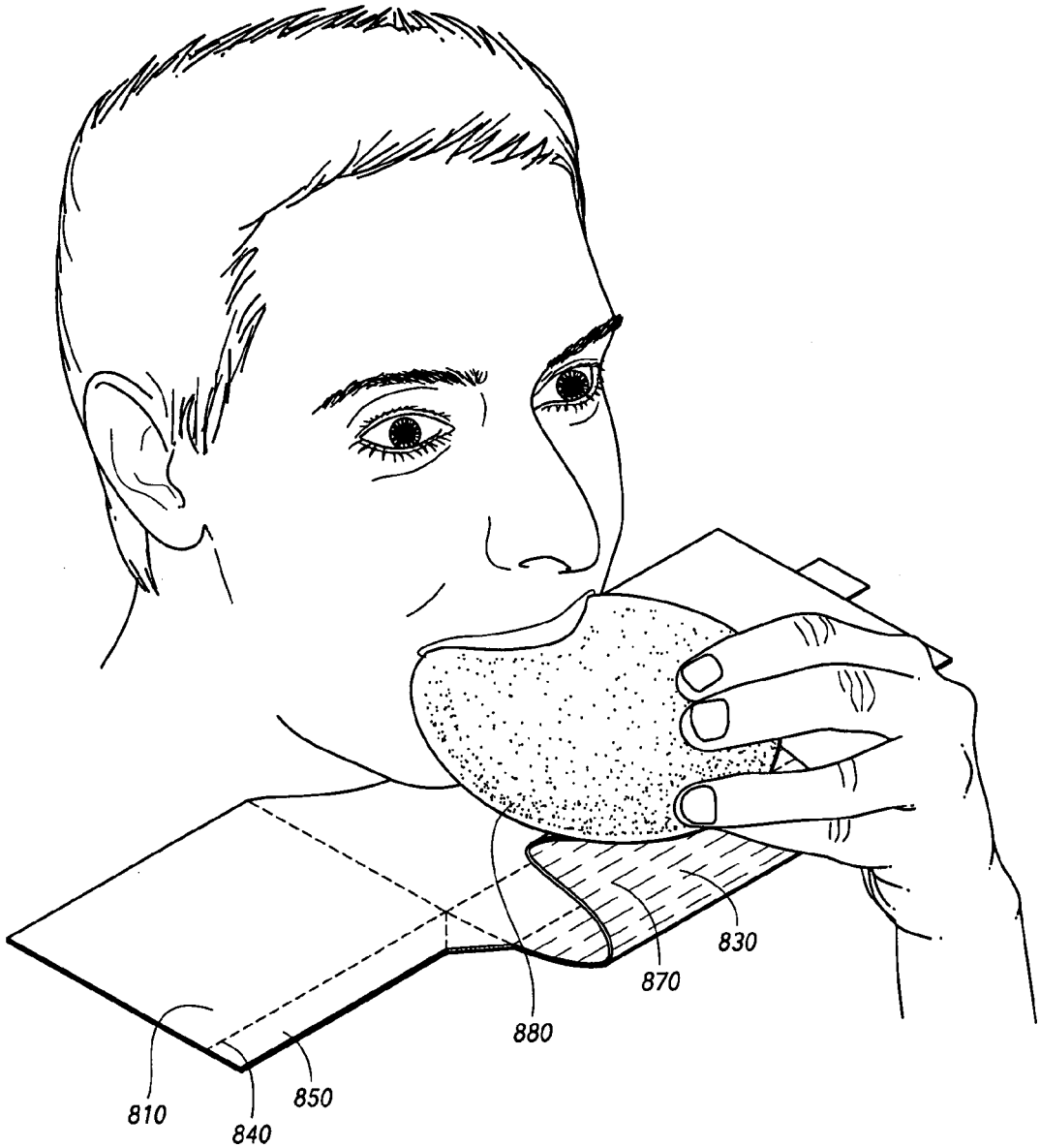
FIG. 14 illustrates the food holder of some embodiments with a food item partially taken out of the food wrapper during consumption of the food item.

FIG. 14 illustrates the food holder of some embodiments with a food item 1400 partially taken out of the food wrapper 880 during consumption of the food item. As shown, base 830 forms into an "S" shape during consumption. In some embodiments, the crease lines 870 help forming the base into "S" shape. As shown, walls 810 and 820 (not shown) together with midsection 885 form an apron that is placed under the chin of the consumer to prevent food particles from spillage. The food item in FIG. 21 is similarly consumed.

Referring to FIGS. 16-19, walls 1610 and 1620 and midsection 1685 form an apron that is located under the chin of the consumer to prevent spillage. Similar to the embodiment of FIG. 8, the optional chin curve 1660 facilitates placing the food holder under the chin of the consumer.

While the invention has been described with reference to numerous specific details, one of ordinary skill in the art will recognize that the invention can be embodied in other specific forms without departing from the spirit of the invention. For instance, different embodiments can have different proportions for the width and/or length of the walls, midsection, base, and flaps to accommodate different sizes and shapes of food items. Different embodiments can have one or more cease lines on the surface (or on the intersections) of the walls, midsection, base, and flaps to facilitate folding of these parts while other embodiments may not have crease lines on some of these location. Thus, one of ordinary skill in the art would understand that the invention is not to be limited by the foregoing illustrative details, but rather is to be defined by the appended claims.

What claimed is:

1. A food container comprising:

a. a back panel;

b. a midsection hingedly connected to the back panel;

c. a first side panel and a second side panel, each side panel hingedly connected to the midsection;

d. a first flap hingedly connected to the first side panel;

e. a second flap hingedly connected to the second side panel;

f. a third flap hingedly connected to the first flap and hingedly connected to the back panel; and g. a fourth flap hingedly connected to the second flap and hingedly connected to the back panel, wherein the back panel, the first and second side panels, the midsection, and the first, second, third, and fourth flaps form a cavity to receive a food item, wherein the midsection, the first side panel, and the second side panel form an apron to place under the chin of a consumer of the food item during consumption of the food item.

2. The food container of claim 1 further comprising a wrapping paper glued to the back panel.

3. The food container of claim 1, wherein the back panel, the first and second side panels, the midsection, and the first, second, third, and fourth flaps are formed from a one piece blank.

4. The food container of claim 1, wherein the midsection comprises an arcuate cut for placing under the chin of the consumer during consumption of the food item.

5. The food container of claim 1 further comprising a tape for connecting the first and second side panels together when said side panels are folded towards each other to form said cavity.

6. The food container of claim 1 further comprising a paper lock for connecting the first and second side panels together when said side panels are folded towards each other to form said cavity.

7. The food container of claim 6, wherein the paper lock comprises a latch on the first side panel and a fissure on the second side panel, wherein when the side panels are folded towards each other, the latch passes through the fissure, wherein the fissure is narrower than a high width of the latch.

8. The food container of claim 6, wherein the paper lock comprises a first fissure on the first side panel and a second fissure and a third fissure on the second side panel, wherein the first fissure goes inside the second fissure and slides into the third fissure in order to lock the first and second side panels together when the side panels are folded towards each other.

9. A food container for preventing spillage during consumption of a food item, the food container comprising:

a. a receptacle formed by a back panel, a midsection, and first and second side panels, the first and second side panels connected to the midsection along first and second fold lines respectively, the midsection connected to the back panel along a third fold line, forming a cavity for holding a food item for human consumption;

b. a first flap connected to the first side panel along a fourth fold line;

c. a second flap connected to the second side panel along a fifth fold line;

d. a third flap connected to the first flap along a sixth fold line and connected to the back panel along a seventh fold line; and e. a fourth flap connected to the second flap along an eighth fold line and connected to the back panel along a ninth fold line;

f. the midsection, the first side panel and the second side panel for forming an apron during consumption of the food item, the apron being placed under the chin of a human during consumption of the food item.

10. The food container of claim 9 further comprising a wrapping paper glued to the back panel.

11. The food container of claim 9, wherein the back panel, the first and second side panels, the midsection, and the first, second, third, and fourth flaps are formed from a one piece blank.

12. The food container of claim 9, wherein the midsection comprises an arcuate cut for placing under the chin of the consumer during consumption of the food item.

13. The food container of claim 9 further comprising a tape for connecting the first and second side panels together when said side panels are folded towards each other to form said receptacle.

14. The food container of claim 9 further comprising a paper lock for connecting the first and second side panels together when said side panels are folded towards each other to form said cavity.

15. The food container of claim 14, wherein the paper lock comprises a latch on the first side panel and a fissure on the second side panel, wherein when the side panels are folded towards each other, the latch passes through the fissure, wherein the fissure is narrower than a high width of the latch.

16. The food container of claim 14, wherein the paper lock comprises a first fissure on the first side panel and a second fissure and a third fissure on the second side panel, wherein the first fissure goes inside the second fissure and slides into the third fissure in order to lock the first and second side panels together when the side panels are folded towards each other.

* * * * *